US011280457B2

(12) United States Patent
MacAllen et al.

(10) Patent No.: US 11,280,457 B2
(45) Date of Patent: Mar. 22, 2022

(54) DIFFUSE LIGHTING SYSTEMS

(71) Applicant: MOLO DESIGN, LTD., Vancouver (CA)

(72) Inventors: Todd P. MacAllen, Vancouver (CA); Stephanie J. Forsythe, Vancouver (CA)

(73) Assignee: MOLO DESIGN, LTD., Vancouver (CA)

( * ) Notice: Subject to any disclaimer, the term of this patent is extended or adjusted under 35 U.S.C. 154(b) by 0 days.

(21) Appl. No.: 16/976,521

(22) PCT Filed: Feb. 26, 2019

(86) PCT No.: PCT/CA2019/050227
§ 371 (c)(1),
(2) Date: Aug. 28, 2020

(87) PCT Pub. No.: WO2019/165545
PCT Pub. Date: Sep. 6, 2019

(65) Prior Publication Data

US 2021/0048157 A1 Feb. 18, 2021

Related U.S. Application Data

(60) Provisional application No. 62/636,923, filed on Mar. 1, 2018.

(51) Int. Cl.
*F21S 4/22* (2016.01)
*F21S 2/00* (2016.01)
(Continued)

(52) U.S. Cl.
CPC ..... *F21S 4/22* (2016.01); *F21S 2/005* (2013.01); *F21S 8/06* (2013.01); *F21V 3/00* (2013.01);
(Continued)

(58) Field of Classification Search
CPC . F21V 1/06; F21V 3/023; F21V 3/026; F21V 3/0625; F21S 4/15; F21S 4/22; F21S 4/24; F21S 4/26
See application file for complete search history.

(56) References Cited

U.S. PATENT DOCUMENTS 8,561,666 B2 10/2013 MacAllen et al.
9,309,668 B2 4/2016 MacAllen et al.
(Continued)

FOREIGN PATENT DOCUMENTS

CA 2297822 A1 2/1999
CN 103775872 A 5/2014
(Continued)

OTHER PUBLICATIONS

International Search Report issued in corresponding PCT Application No. PCT/CA2019/050227; Search completed Apr. 4, 2019.

*Primary Examiner* — Sean P Gramling

(57) ABSTRACT

Light fixtures often have bright spots caused by the light sources that can be unpleasant or uncomfortable to look at. A light system is provided that diffuses the light. The light system includes an exterior body defining a void therein and an internal structure positioned within the void. The internal structure comprises at least a web and a flange extending from the web, and one or more lights positioned along the length of the web. The internal structure supports the exterior body.

22 Claims, 32 Drawing Sheets

(51) Int. Cl.

| | |
|---|---|
| ***F21S 8/06*** | (2006.01) |
| ***F21V 3/00*** | (2015.01) |
| ***F21V 11/06*** | (2006.01) |
| ***F21V 17/08*** | (2006.01) |
| ***F21V 21/005*** | (2006.01) |
| ***F21V 21/14*** | (2006.01) |
| *F21Y 103/33* | (2016.01) |
| *F21Y 103/10* | (2016.01) |
| *F21Y 115/10* | (2016.01) |
| *F21V 17/00* | (2006.01) |

(52) U.S. Cl.

CPC ..... *F21V 11/06* (2013.01); *F21V 17/08* (2013.01); *F21V 21/005* (2013.01); *F21V 21/14* (2013.01); *F21V 17/007* (2013.01); *F21Y 2103/10* (2016.08); *F21Y 2103/33* (2016.08); *F21Y 2115/10* (2016.08)

(56) References Cited

U.S. PATENT DOCUMENTS

| | | | | |
|---|---|---|---|---|
| 9,394,686 | B2 | 7/2016 | MacAllen et al. | |
| 9,797,134 | B2 | 10/2017 | MacAllen et al. | |
| 2015/0204506 | A1 | 7/2015 | Wu | |
| 2015/0260361 | A1* | 9/2015 | Cho | F21S 4/22 362/249.04 |
| 2016/0178135 | A1* | 6/2016 | Xu | F21V 25/04 362/223 |

FOREIGN PATENT DOCUMENTS

| | | | |
|---|---|---|---|
| CN | 104180248 | A | 12/2014 |
| CN | 206875223 | U | 1/2018 |

* cited by examiner

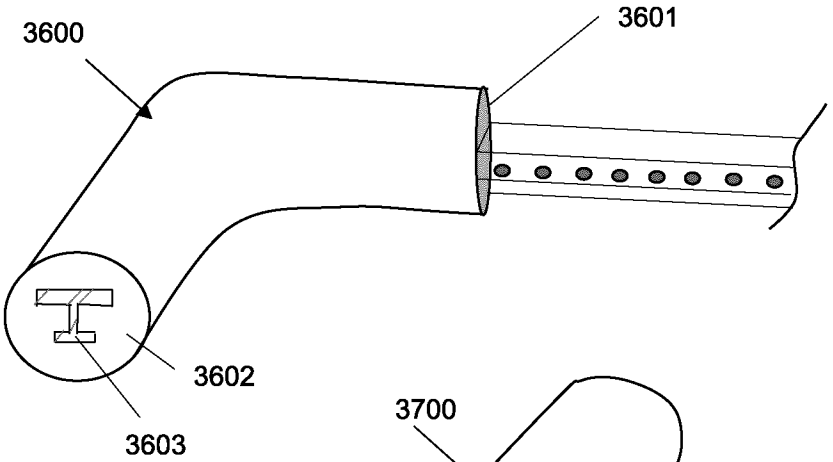
FIG. 36
FIG. 37
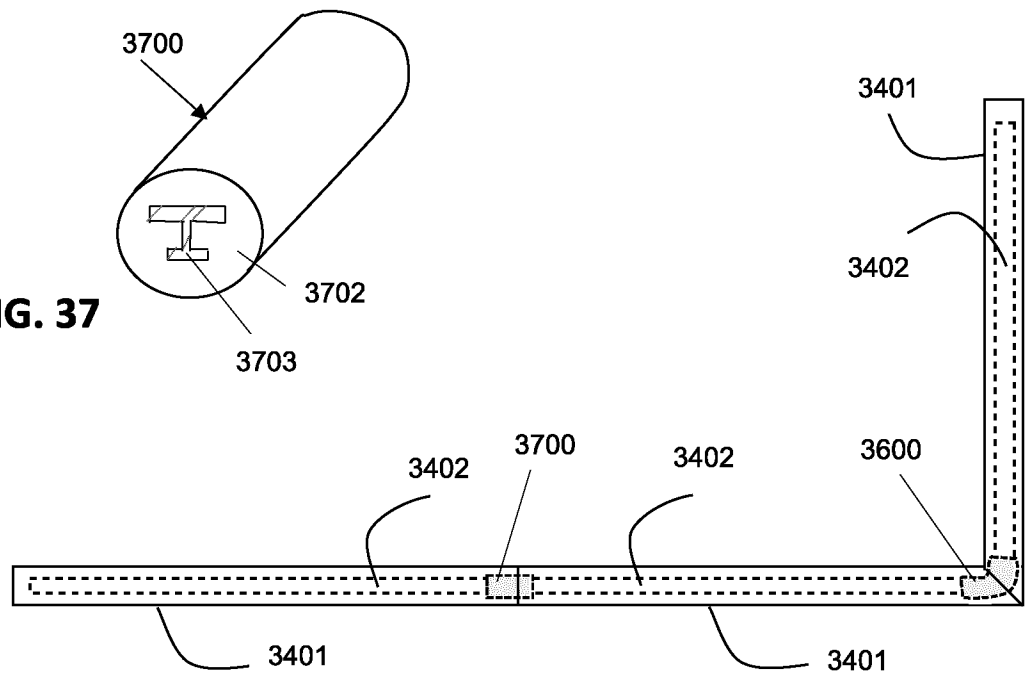
FIG. 38

DIFFUSE LIGHTING SYSTEMS

CROSS-REFERENCE TO RELATED APPLICATION

This application claims priority to U.S. Provisional Patent Application No. 62/636,923 filed on Mar. 1, 2018 and titled "Diffuse Lighting Systems", the entire contents of which are hereby incorporated by reference.

TECHNICAL FIELD

The following generally relates to diffuse lighting systems and methods of making these systems.

DESCRIPTION OF THE RELATED ART

Lighting systems are used to illuminate a space, such as a room. Lighting systems are a staple product used in domestic, working and public environments. Lighting systems can be hung from an overhead structure, such as a ceiling, or mounted to a wall, or supported from a movable base.

Lighting systems typically include light bulbs or light emitting diodes (LEDs) that form points of light. To diffuse the light being emitted, it is typical to use light shades. These light shades can be made from cardboard, plastic, colored or stained glass, etc. Examples of light shades include lamp shades. Light shades or lamp shades are commonly used in light fixtures, pendant lights, chandeliers, hanging lights, and floor lamps.

It is herein recognized that, even with light shades, the light is not even distributed across the light shade. A person can see a point source of light, although it point source is somewhat diffused. In other words, the portion of the light shade surface that is closest to the light bulb or LED is significantly brighter than other portions of the light shade surface. Diffusing a point source of light with a light shade is even more difficult if the light shade has holes or apertures.

Moreover, illuminating a larger space becomes more difficult. For example, using a single light source (e.g. one light bulb or one LED) creates a very bright point of light. It is very difficult to diffuse a single light source using a light shade that is intended to be bright enough to light an entire room. Typically, such a light source would also generate heat, which could potentially cause a fire hazard.

Many points of lights, for example many light bulbs or LEDs, could be incorporated into a lighting system used to illuminate a large space more evenly. However, these multiple points of light could also potentially cause a fire hazard as they generate a lot of heat in aggregate. It is further recognized that the light emitted these multiple points of light may also be difficult to diffuse, so as to generate a "look" or a perception that the lighting system is a single large light source.

It is also herein recognized that the larger the lighting system, typically the larger the physical structure is used to support the lighting system. For example, lighting fixtures for large ceiling chandeliers can include large metal rings with spokes to hold up a ring of light bulbs. Therefore, a large-sized light system can be very heavy. Typically, the larger the light system, the more difficult it is to pack and transport. For example, many larger light systems have a voluminous rigid framework that is cumbersome, or costly, or both, to transport. These larger light systems would also require significant storage space and would be difficult to setup and takedown.

It also recognized that, as a result of the inconvenient transport, storage, setup, or takedown, or combinations thereof, these larger lighting systems are not well suited for illuminating open plan areas that are temporarily purposed (e.g. temporary display areas, temporary work places, temporary meeting areas, retail rooms, theatrical settings, etc.).

The above disadvantages are herein recognized.

BRIEF DESCRIPTION OF THE DRAWINGS

Example embodiments of a diffuse lighting system will now be described by way of example only with reference to the accompanying drawings in which:

FIG. 36 is a perspective view of an elbow connector that has ends for connecting to two internal structures, according to another example embodiment.

FIG. 37 is a perspective view of a linear connector that has ends for connecting two internal structures, according to another example embodiment.

FIG. 38 is a top view of the vertically oriented lighting panels of FIG. 34 fastened together, and further showing the elbow connector of FIG. 36 and the linear connector of FIG. 37.

DETAILED DESCRIPTION

Figure 1:
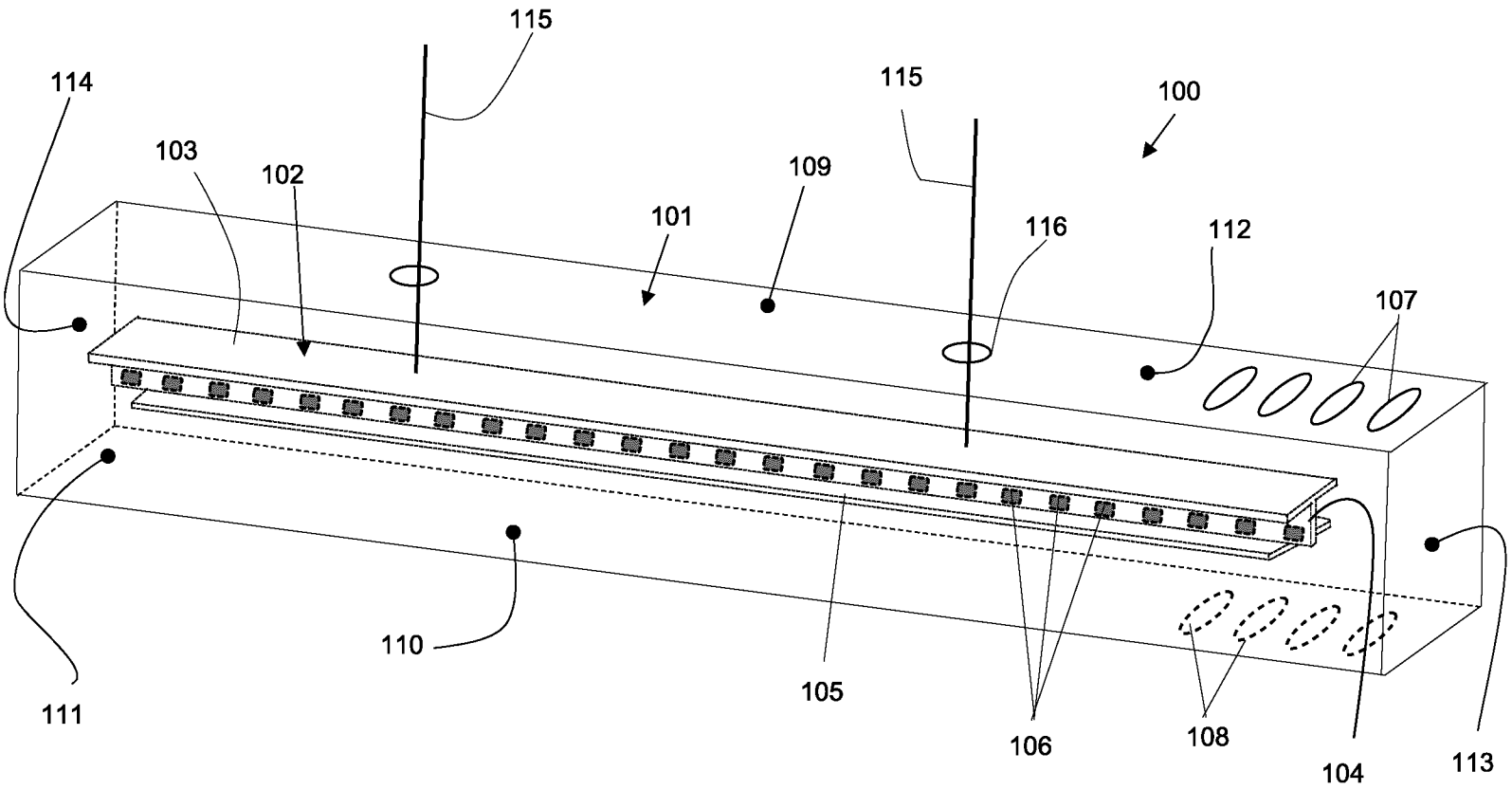
FIG. 1 is a perspective view of an example embodiment of a hanging lighting system, showing an internal supporting structure.

It will be appreciated that for simplicity and clarity of illustration, where considered appropriate, reference numerals may be repeated among the figures to indicate corresponding or analogous elements. In addition, numerous specific details are set forth in order to provide a thorough understanding of the example embodiments described herein. However, it will be understood by those of ordinary skill in the art that the example embodiments described herein may be practiced without these specific details. In other instances, well-known methods, procedures and components have not been described in detail so as not to obscure the example embodiments described herein. Also, the description is not to be considered as limiting the scope of the example embodiments described herein.

Turning to FIG. 1, an example embodiment of a lighting system 100 is shown. It includes an exterior body 101 that houses within it an internal supporting structure 102. In particular, the exterior body 101 defines an interior space or cavity, and the internal supporting structure 102 is positioned within this interior space. The internal supporting structure 102 supports the exterior body 101. This support could be implemented in various ways. For example, an interior surface of the exterior body 101 rests on the internal supporting structure 102. In another example, the exterior body has a frame (not shown) and the frame rests on the internal supporting structure 102, or the frame is joined or attached to the internal supporting structure 102.

The exterior body 101, in this example, has a top surface 109, a bottom surface 110, two opposite side surfaces 111, 112, and two opposite end surfaces 113, 114. In an example embodiment, these surfaces are translucent. The surfaces can have holes or apertures defined therein to allow for light to pass through the surfaces. The holes or apertures in these surfaces also allow air to pass into and out of the exterior body 101, which facilitates convective heat transfer from the one or more light elements 106 on the internal supporting structure 102.

For example, the holes 107 are positioned on the top surface 109 and the holes 108 are positioned on the bottom surface 110, and the opposite side surfaces 111, 112 do not have holes. Although not shown, in other embodiments, the holes can be positioned all along the length of the exterior body 101, on its top surface and on its bottom surface. Therefore, light rays from the lights 106 positioned on the web 104 of the internal supporting structure 102 reflect off or pass through different internal surfaces, or both, before passing through the holes in the top surface or the bottom surface. For example, some light reflects off a given flange of the internal supporting structure 102 (if the flange is opaque); some light passes through a given flange of the internal supporting structure 102 (if the flange is translucent); or some light reflects off the internal surfaces of the exterior body; or a combination thereof, before passing through the holes. Some other light rays from the lights 106 transmit and scatter as it passes through the side walls 111, 112 of the exterior body 101.

It can be appreciated that the placement, shape, and number of holes can vary according to the design of the lighting system. In the example shown in FIG. 1, there are also holes 116 in the top surface 109, through which support cables or support rods 115 pass through. For example, one end of each given support cable or support rod is connected to the internal supporting structure 102 and the other end of each given support cable or support rod is connected to an overhead structure (e.g. a ceiling structure, a truss, a beam, etc.).

It will be appreciated that the shape and dimensions of the exterior body 101 can vary from what is shown in the figures provided herein according to design. It can be appreciated that there are many configurations of the exterior body that have a void for an internal structure (e.g. panels joined at edges, a frame with a covering material mounted thereon, cellular structures, etc.).

The surfaces that make the exterior body 101 can be made of various materials that are opaque or translucent. Whilst a translucent material is preferred, it will be apparent that opaque or different colored materials may also be utilized. If the surfaces are opaque, then holes or apertures would be needed to allow light to emit from the lighting system. Examples of surface materials include, but are not limited to, plastics, woven fabrics, non-woven fabrics, glass, paper, paper composites, and fabric composites. For example, the material under the trade name Tyvek from DuPont could be used to form the surfaces of the exterior body 101.

In an alternative example embodiment (not shown in FIG. 1), there are no holes in surfaces of the exterior body.

Continuing with FIG. 1, the internal supporting structure 102 is rigid and shaped as an I-beam. It includes an upper horizontal element, also called a flange 103, a vertical element, also called a web 104, and a lower horizontal element, also called a flange 105. In the example shown, the upper flange 103 and the web 104 are integrally formed, forming T-channel or T-beam, and the lower flange 105 is attached or fixed to the web 104. In an alternative example embodiment, these three elements of the I-beam are integrally formed. In another alternative example, each of these three elements are attached or fixed together to form the I-beam.

Lights 106 are mounted to the web 104. For example, a series of LEDs are adhered or attached in some other manner to the sides surface (or surfaces) of the web 104. In another example, a series of other types of lights (e.g. incandescent, fluorescent, etc.) are mounted to the web 104. In another example embodiment, a long light source is mounted to a side surface of the web 104, or two long light source are respectively mounted to the two side surfaces of the web 104. For example, the long light source extends along the entire length of the web 104, or extends along the majority of the length of the web 104. For example, the long light source is a fluorescent tube. In another example, the long light source is a strip of organic light emitting diode. It will be appreciated that other types of currently known and future known light sources can be applied to the lighting systems described herein.

In an example embodiment, the upper flange 103 and the web 104 are opaque, and the lower flange 105 is translucent.

In another example embodiment, both the upper flange 103 and the lower flange 105 are opaque. The web 104 is translucent, transparent or opaque.

In another example embodiment, both the upper flange 103 and the lower flange 105 are translucent. The web 104 is translucent, transparent or opaque.

In another example embodiment, the upper flange 103 is translucent and the lower flange 105 is opaque. The web 104 is translucent, transparent or opaque.

In an example aspect, the upper flange 103 or the lower flange 105, or both, are colored to match the same color, or to be a similar color, as the color of the exterior body 101. In this way, when an observer looks at the lighting system, it is difficult to see or notice the internal supporting structure housed within the exterior body.

Figure 2:
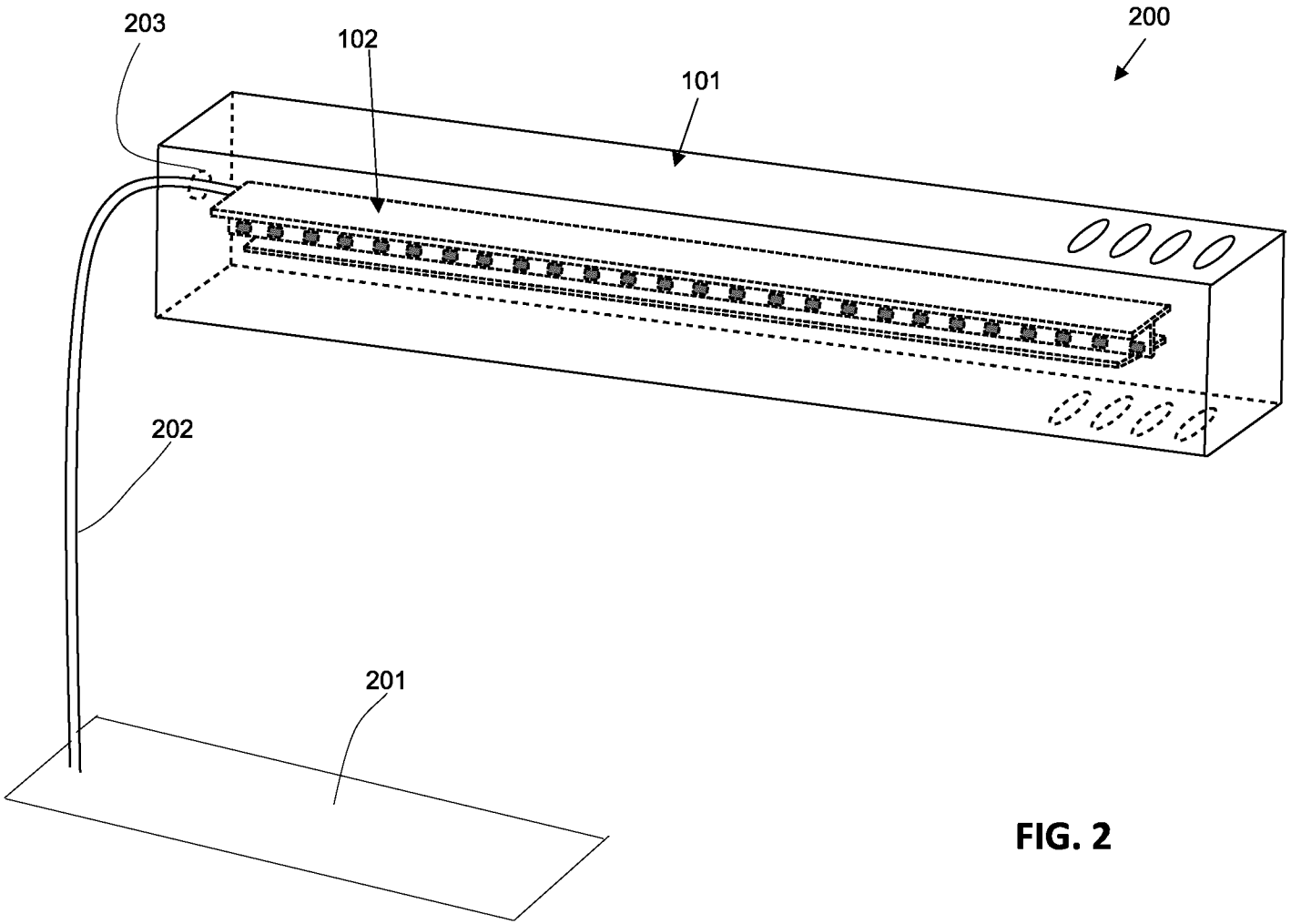
FIG. 2 is a perspective view of another example embodiment of a lighting system with a supporting arm connected to an internal supporting structure.

FIG. 2 shows a variant of the lighting system in FIG. 1, but the lighting system 200 shown in FIG. 2 is instead supported using an armature 202 that is joined or fixed to the internal structure 102. The armature 202 is connected to a base 201 that sits on a floor or other surface, and the armature 202 passes through a hole or opening 203 in the surface of the exterior body 101.

There are variants to the shape and the configuration of the internal supporting structure. Examples of these variants are described below. There are also variants to the shape and configuration of the external body, and examples of these variants are described below. It will be appreciated that different combinations of internal supporting structures and external bodies are applicable to the principles described herein, even if these combinations are not explicitly described herein.

FIGS. 3 to 7 show various examples of internal structures in isolation, which are shaped as an I-beam, that could be used in a lighting system.

Figure 3:
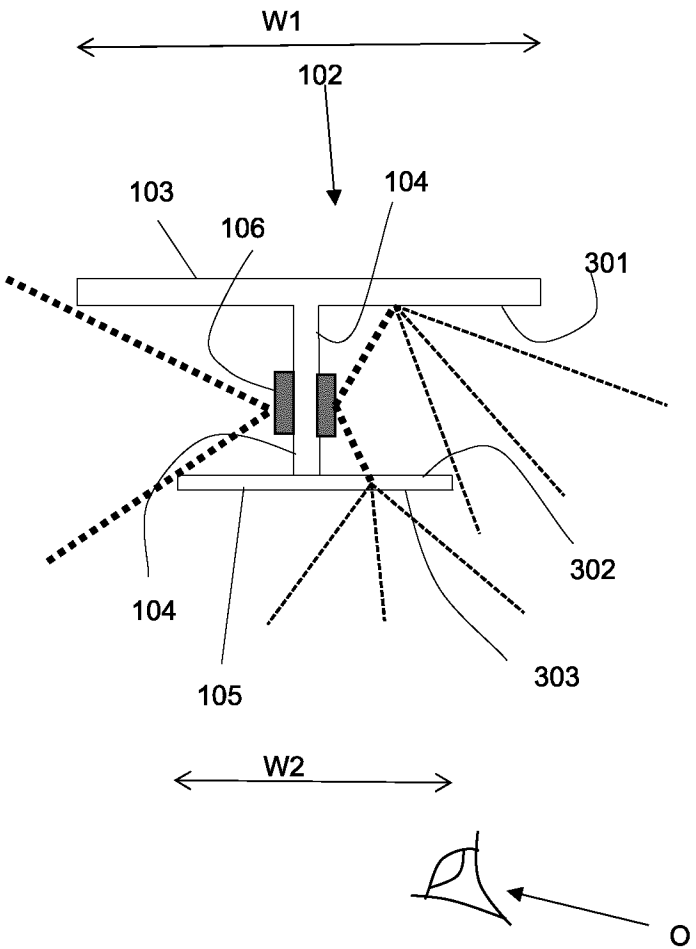
FIG. 3 is a front view or rear view of an example of an internal supporting structure shown in isolation, and that includes lights and translucent surfaces.

FIG. 3 shows the example embodiment of the internal structure 102 as illustrated in the lighting systems of FIGS. 1 and 2. As can be seen from the front view or rear view in FIG. 3, there are lights 106 positioned on both sides of the web 104. Dotted lines show example rays of light that are emitted from the lights 106. For example, light rays are emitted from the lights 106 and some of the light rays pass through a translucent material of the lower flange 105. In particular, as light rays enter through the top surface 302 of the lower flange 105 and exits through the lower surface 303 of the lower flange 105, the light rays scatter and are diffused. In this way, as an observer (O) is positioned below and looks up at the lighting system, even when looking at the location of the lights 106, there are no intense bright points of light. The light is further diffused as it passes through the material of the exterior body 101.

In an example embodiment, the flange 105 is a translucent glass or a translucent plastic. Other translucent materials may be used.

In an example embodiment, the translucent material of the flange allows less light to pass through compared to the amount of light that is able to pass through the material of the exterior body. Or, in other words, the material of the exterior body is more translucent than the material of the flange 105.

In an alternative embodiment, the material of the exterior body is equally translucent to the material of the flange 105.

In yet another alternative embodiment, the material of the exterior body is less translucent compared to the material of the flange 105. For example, the exterior body is opaque and includes holes to allow for light to pass through.

In an example embodiment, the flange 105 is colored to be the same color or have a similar color shade as the exterior body 101. In another example embodiment, the flange 105 has a different color compared to the color of the exterior body. In another example embodiment, the flange 105 does not have a color per se, such as the appearance or effect of frosted glass. The frosted glass effect is not necessarily produced using glass, but can also be achieved by other materials, such as by films or coatings, or a combination thereof.

Continuing with FIG. 3, the upper flange 103 and the web are opaque. The lower surface 301 of the upper flange 103 has an uneven surface or a textured surface in order to scatter the light rays that hit it, and to at least partially reflect the scattered light waves downwards to the observer (O). For example, the lower surface 301 has a powder coated surface which includes numerous and very small bumps that scatter the light rays. The texture of the power coated surface reduces the sheen of the light rays and reduces the hot spots. In another example, the texture of the lower surface 301 is produced by mechanically "roughing" the surface. This can be done by making imprints or scratches on the lower surface 301. These numerous and small undulations and angled surfaces scatter the light rays that hit the lower surface 301. In another example embodiment, another type of textured coating is sprayed or adhered to the lower surface. It is appreciated that there are other ways to manufacture an uneven or textured surface. In an example aspect, the surfaces of the web are also uneven or textured.

The width W1 of the upper flange 103 is wider than the width W2 of the lower flange 105. This allows more light rays to be cast downwards. In another example aspect, as best seen in the perspective views of FIG. 1 and FIG. 2, the length of the lower flange 105 is shorter than the length of the upper flange 103. This also allows more light rays to be cast downwards. In another example embodiment, the widths W1 and W2 are equal.

As can be seen from FIG. 3, the majority of the light is cast downwards in an evenly diffused manner. Therefore, when this internal supporting structure is used with an exterior body, from the perspective of the observer, the entire lighting system appears to be evenly illuminated. The visual effect of evenly distributed lighting is also achieved with very large-sized lighting systems.

Furthermore, the web 104 and the upper flange 103 are made of thermally conductive material (e.g. a metal or metal alloy) that functions as a heat sink. In particular, the lights 106 mounted or positioned on the sides of the web 104 generate heat, and this heat is conducted through the web 104 and the upper flange 103. As air passes over the large surface area of the web 104 and the upper flange 103, the heat is transferred from the internal supporting structure 102 to the surrounding air by convection. This removes effectively removes heat from the lights 106 and reduces or avoids thermal hots spots on the internal structure 102. In particular, the heat is evenly distributed across the web and across the upper flange. In turn, the reduction of hot spots reduces fire hazards. For example, if paper, textile or fabric material in the exterior body is positioned near the internal supporting structure 102 or touches the internal supporting structure 102, then it is even more important that there are no hot spots that could burn the paper, textile or fabric materials.

Similar principles and features are shown in the examples of FIGS. 4 to 7.

Figure 4:
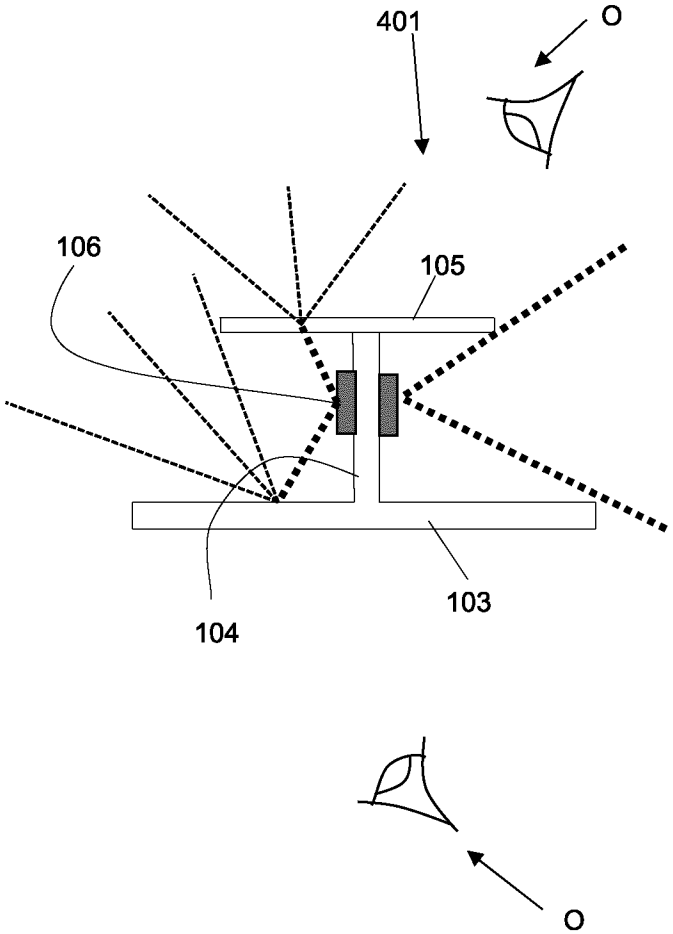
FIG. 4 is a front view or rear view of an example of another internal supporting structure shown in isolation. The supporting structure in FIG. 4 is oriented upside-down relative to the embodiment shown in FIG. 3.

In FIG. 4, the internal supporting structure 401 is very similar to the internal supporting structure 102, but flipped upside down. As a result, the observer (O) positioned below the internal supporting structure 401 sees less light being cast downwards. Using the internal supporting structure 401, more light is cast or directed upwards. This may be desirable to provide up-lighting. For example, it is also understood that an observer (O) may be positioned above the lighting system and that it is also desirable to reduce the bright spots seen by an observer positioned overhead. Consider a multi-level open-air atrium in which a lighting system is positioned mid-way between two levels, and there are observers positioned on the second level above the lighting system. The lighting system having the internal supporting structure 401 provides up-lighting to the second level while being pleasing to eyes of those observers on the second level.

Figure 5:
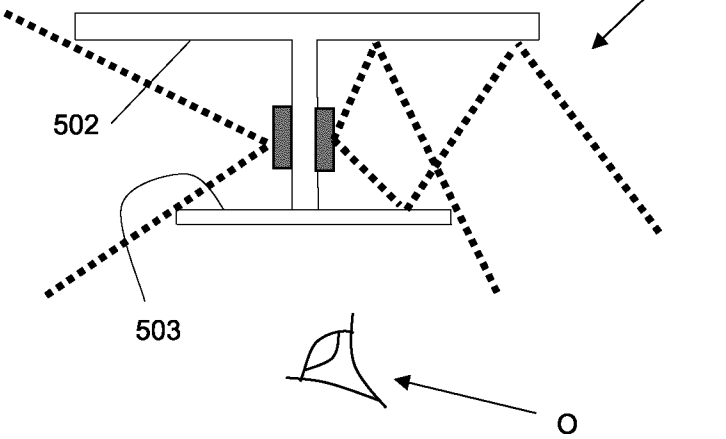
FIG. 5 is a front view or rear view of an example of another internal supporting structure shown in isolation, and that includes lights and reflective surfaces.

In FIG. 5, another example of an internal supporting structure 501 is shown. While similar in shape to the internal supporting structure 102, the materials or surfaces, or both, are different. The upper surface 503 of the lower flange and the lower surface 502 of the upper flange are opaque. In example embodiment, these surfaces 502 and 503 are reflective surfaces. For example, these surfaces 502 and 503 are a reflective metal surface, a mirrored surface, a reflective coating, etc. These reflective surfaces are not textured. In another example embodiment, these reflective surfaces are textured, which would scatter the light rays. The lower flange in FIG. 5 has a smaller width relative to the upper flange, which allows more light to be cast downwards.

Figure 6:
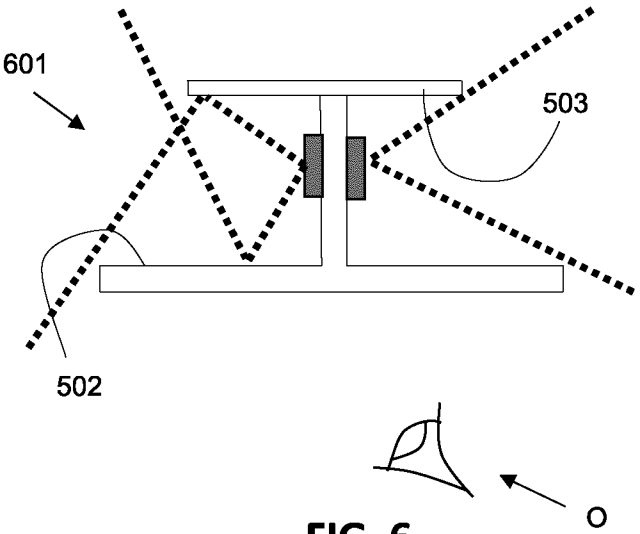
FIG. 6 is a front view or rear view of an example of another internal supporting structure shown in isolation. The supporting structure in FIG. 6 is oriented upside-down relative to the embodiment shown in FIG. 5.

FIG. 6 shows another example of an internal supporting structure 601, which is the same as the internal supporting structure 501, but oriented upside down. In this way, more light is cast upwards since the lower flange is wider than the upper flange.

Figure 7:
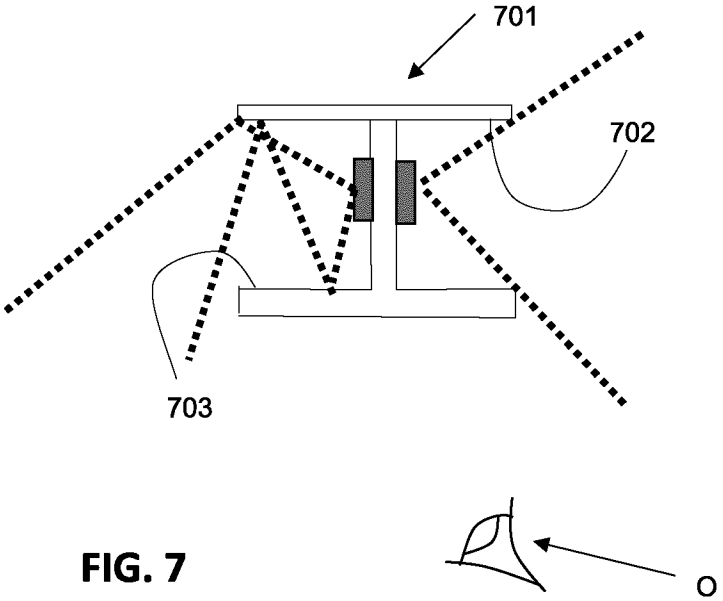
FIG. 7 is a front view or rear view of an example of another internal supporting structure shown in isolation, and that includes upper and lower reflective surfaces of substantially the same width.

FIG. 7 shows another example of an internal supporting structure 701 which includes an upper flange with a lower surface 702 that is reflective, and a lower flange with an upper surface 703 that is reflective. The upper flange and the lower flange are of the same width.

While it is preferred that an exterior body be used in combination with the internal supporting structures described herein, in other example embodiments, there is no exterior body. In other words, a given internal supporting structure is used by itself and it is not further covered or obstructed.

In other example embodiments, a different covering or shading (e.g. an exterior body) is used with a given internal supporting structure to further diffuse the light. In yet another alternative example, a given internal supporting structure is positioned within an exterior body, but the exterior body is supported by some other means (e.g. wires or another structure) instead of by the internal supporting structure that has the lights.

In other words, a given internal supporting structure can also be utilized so that it is not "internal" relative to a covering body, or the structure is not "supporting" a covering body, or both.

It is also appreciated that, whilst many of the examples show the lights positioned on the web of an internal structure, the lights may alternatively or additionally be positioned on one or more flanges.

Figure 8:
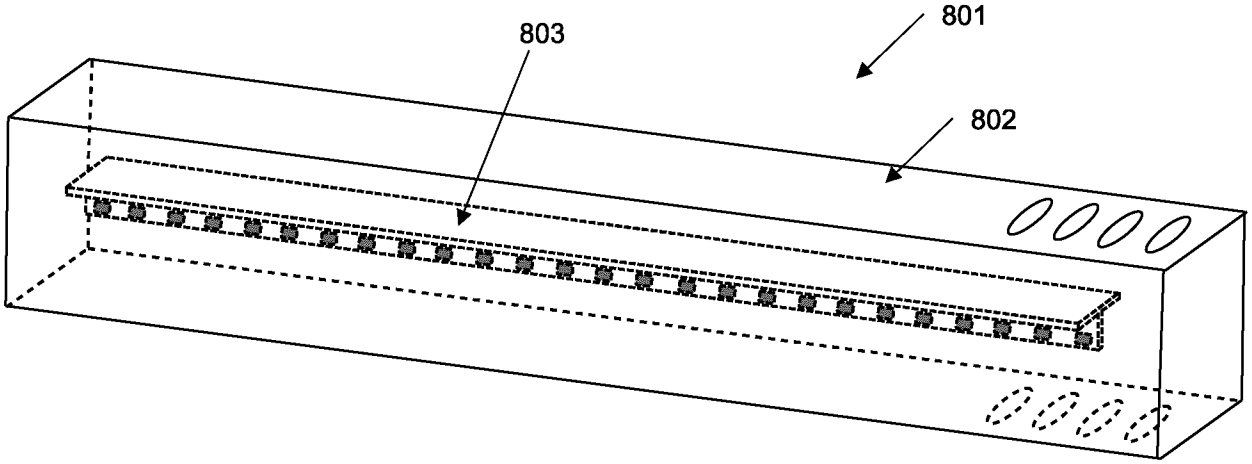
FIG. 8 is a perspective view of another example of a lighting system with a T-shaped internal structure.
Figure 9:
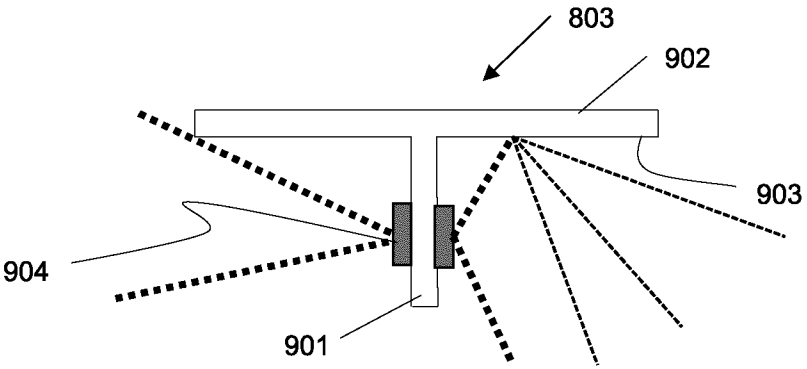
FIG. 9 is a front view or a rear view of the T-shaped internal structure of FIG. 8, but shown in isolation.

Turning to FIGS. 8 and 9, another example embodiment of a lighting system 801 is shown. It includes an exterior body 802 and an internal structure 803, which is shown in isolation in FIG. 9. The internal structure 803 is a T-shaped beam that includes an upper flange 902 and a vertical web 901 that protrudes from the middle, or near the middle, of the width of the upper flange 902. Light sources (e.g. light bulbs, LEDs, etc.) 904 are, or an elongate light strip is, positioned along each side surface of the web 901. The lower surfaces 903 of the upper flange 903 is, for example, an opaque surface that is textured or uneven, so as to scatter the light rays. Examples of textured surfaces or uneven surfaces were described with respect to the flange 103 in FIG. 3.

Figure 10:
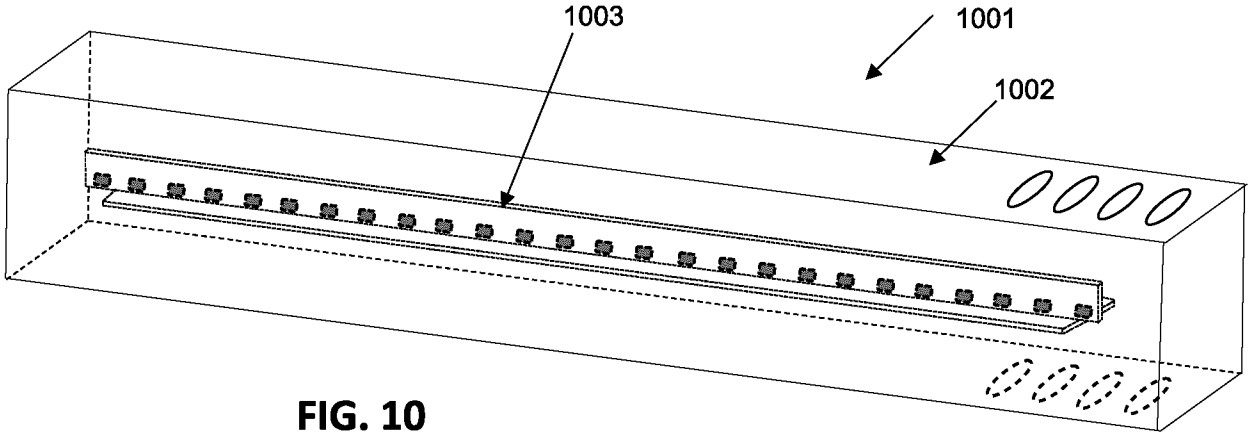
FIG. 10 is a perspective view of another example of a lighting system with an upside-down oriented T-shaped internal structure.
Figure 11:
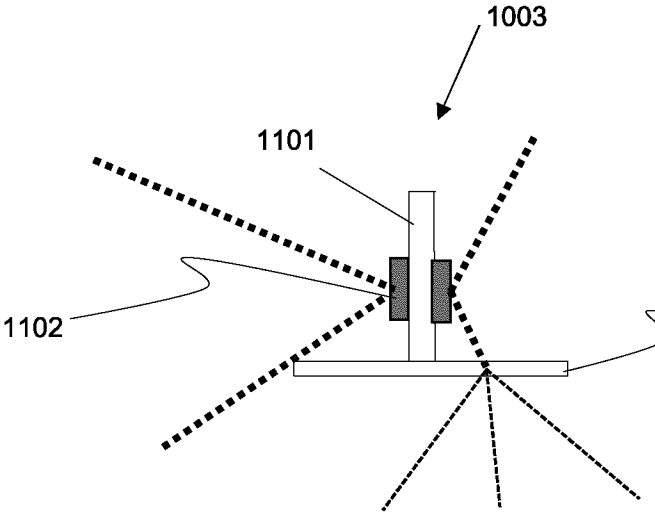
FIG. 11 is a front view or a rear view of the upside-down oriented T-shaped internal structure of FIG. 10, but shown in isolation.

FIGS. 10 and 11 show another example embodiment of a lighting system 1001. It includes an exterior body 1002 and an internal structure 1003, which is shown in isolation in FIG. 11. The internal structure 1103 is an upside down T-shaped beam that includes a lower flange 1003 and a vertical web 1101 that protrudes from the middle, or near the middle, of the width of the lower flange 1103. Light sources (e.g. light bulbs, LEDs, etc.) 1102 are positioned along each side surface of the web 1101, or an elongate light strip is positioned along each side surface of the web 1101. The lower flange 1103 is a translucent material. Examples of translucent materials and example characteristics of different translucent materials are described above with respect to the flange 105 in FIG. 3.

Figure 13:
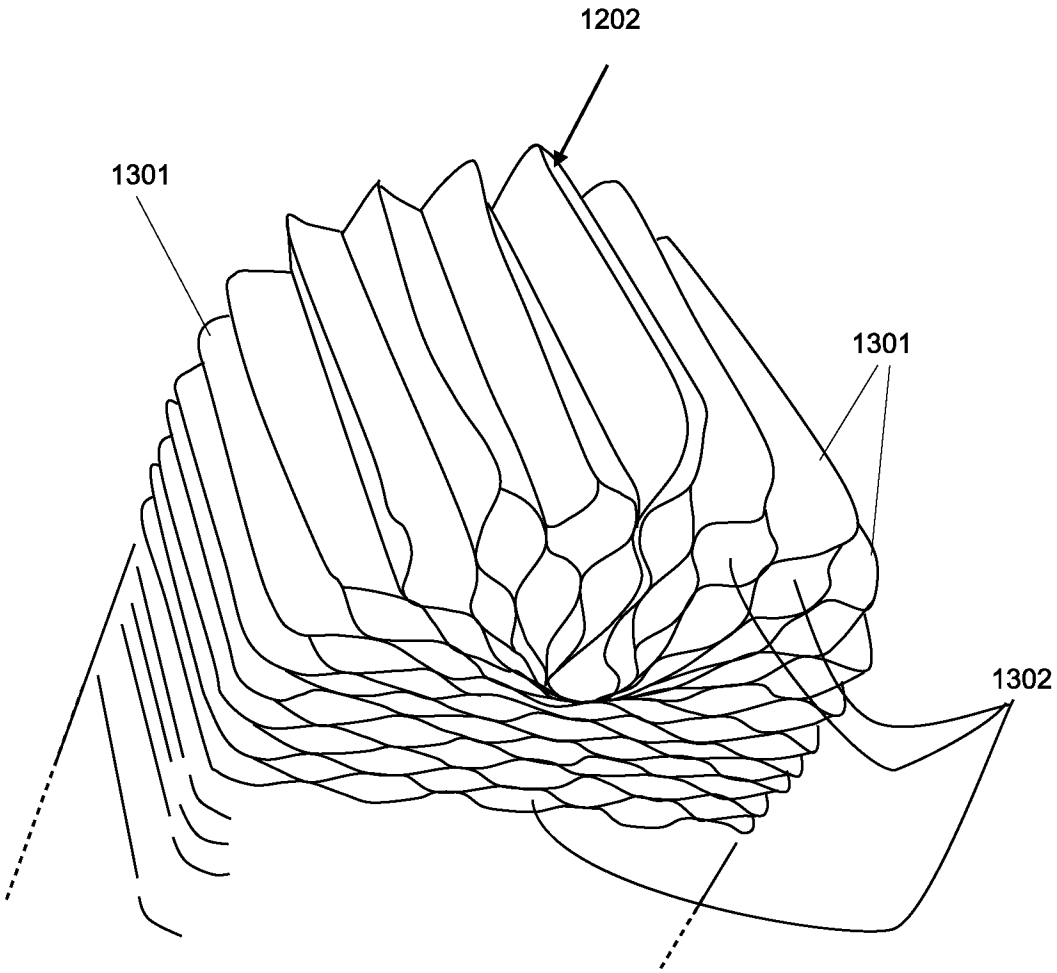
FIG. 13 is a bottom perspective view of a portion of the lighting system shown in FIG. 12.
Figure 14:
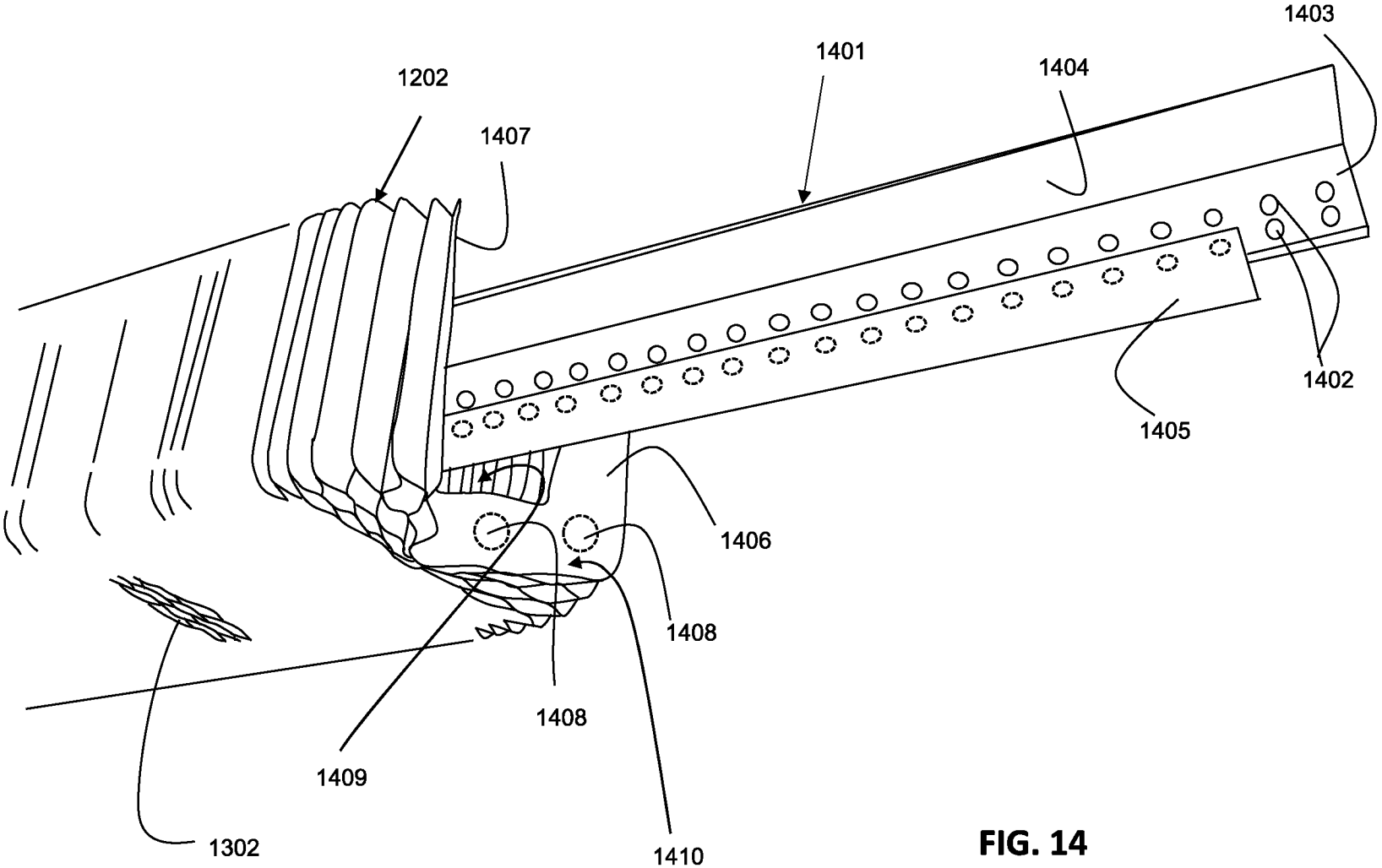
FIG. 14 is a perspective view of the lighting system shown in FIG. 12, and with the flexible light shade pulled back to show an internal structure.
Figure 15B:
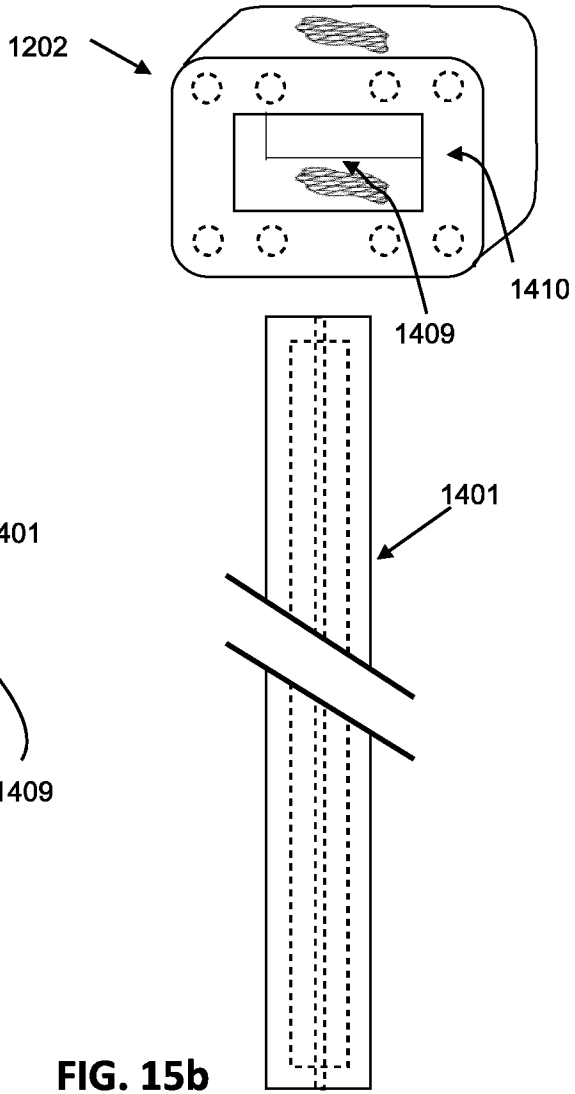
FIG. 15*b* is a kit of parts of the lighting system shown in FIG. 12, including the flexible light shade in a compressed stated and the internal structure in a disassembled state.
Figure 15A:
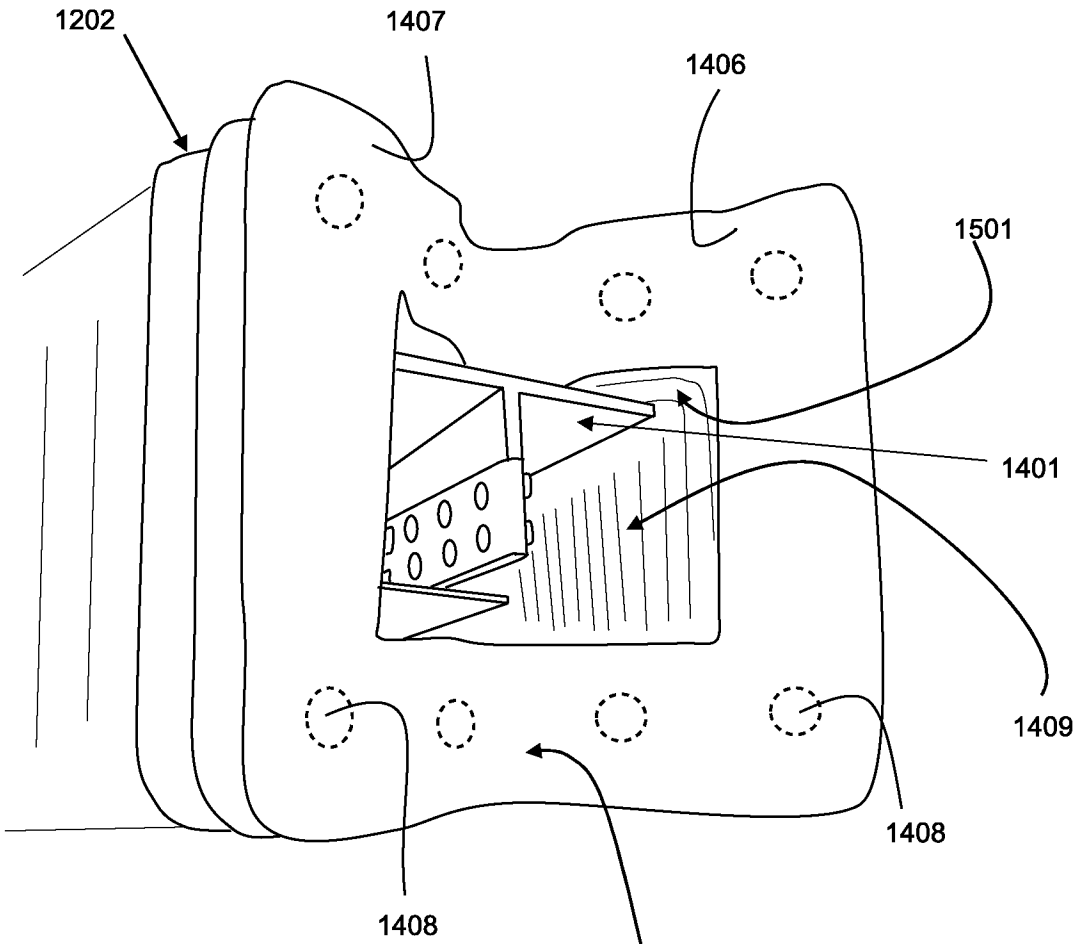
FIG. 15*a* is another perspective view of the lighting system shown in FIG. 12, and with the flexible light shade opened at one end to show the internal structure.

FIGS. 12 to 15*a* and 15*b* show an example embodiment of a lighting system 1201 that includes an exterior body 1202 and support rods or support wires 1203 that are connected to an internal supporting structure 1401. The internal supporting structure 1401 is located within a void 1409 within the exterior body 1202. The void 1409 extends along the majority of the length of the supporting structure, and the structure 1401 spans along the majority of the length of the exterior body 1202. As best shown in FIG. 15*a*, the upper surface or surfaces 1501 that define the void 1409, rests on top of the upper flange of the internal supporting structure 1401. In this way, the internal supporting structure 1401 supports the exterior body 1202.

The exterior body 1202 has a series of vertical channels 1302 that are separated from each other by vertically oriented surfaces and that extend from a bottom side of the exterior body to the top side of the exterior body. This is best shown in FIGS. 13 and 14. Light from the internal supporting structure is emitted through the openings in these channels. Preferably, the material of the exterior body is translucent, so that light is also to be emitted through the material of the exterior body. The shape of the channels, as best shown in FIG. 13, is like a honey comb. However, other shapes of these vertical channels can be used. For example, the channels may be circular shaped, diamond shaped, oval shaped, or irregularly shaped.

In a preferred embodiment, the exterior body 1202 is collapsible and expandable for easy storage and shipping. For example, folds in the material or joints between pieces of the material, or both, facilitate the horizontal collapsing and the horizontal expansion of the exterior body. While the exterior body 1202 is collapsible and expandable, other types of exterior bodies that are not collapsible and expandable are still able to be used with the various internal structures described herein.

In an example embodiment, the exterior body 1202 is a flexible article can be collapsed and extended. The exterior body comprises a core and a pair of end panels at opposite ends of the core. The core is formed from a plurality of panels. The panels in the core each have a pair of oppositely-directed major faces. The panels are preferably formed from a flexible flaccid material. In an alternative embodiment, the panels are formed from a rigid material or semi-rigid material. The material forming the panels is a flame retardant material that could be formed of tissue paper, a non-woven textile, or a woven textile. For example, Tyvek from DuPont could be used to form the panels. Other materials include cardboard, cardboard composites, plastics, and plastic composites. It will be appreciated that materials could be combined in different ways. Each panel has a major dimension or height and a width which may be adjusted to suit particular environments. Adjacent panels are inter-connected to one another at spaced intervals that alternate across the width of the face of the panel. The connection between adjacent panels is through a series of parallel, laterally-spaced strips on the face of a given panel. The strips are defined by stripes of adhesive, or some other joining mechanism or process, which joins the adjacent panels to one another.

Each of the panels is therefore alternately connected to adjacent given panels on opposite sides so that, upon extension of the panel in a horizontal direction, a cellular structure having vertical channels 1302, which are vertical voids, is formed within the core. The voids extend vertically from top to bottom of the core with the panels providing a continuous transverse barrier. The lateral outer ends of each of the panels are connected so as to form vertical pleats 1301 on the exterior faces of the core.

Figure 12:
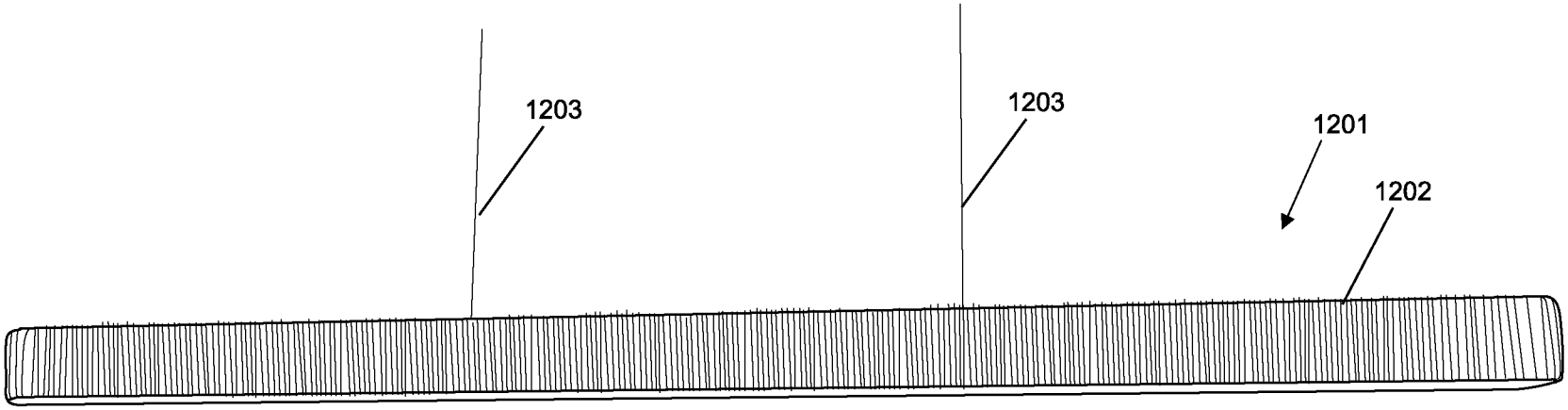
FIG. 12 is a perspective view of a lighting system with a flexible light shade, according to an example embodiment.

As best shown in FIGS. 14 and 15*a*, an end panel 1410 is show in an open position to show the void 1409 that extends horizontally along the exterior body 1202. The end panel 1410 is formed from a flexible material and is adhered to the panels positioned at the end of the core. The opposite ends 1407 and 1406 of the end panel 1410 can be folded together to face each other, as shown in FIG. 13. FIG. 12 also shows that both end panels of the exterior body 1202 are in the closed or folded position. Turning back to FIGS. 14 and 15*a*, the end panel has magnets 1408 that are positioned on opposite sides 1407, 1406 so as to hold or fasten the opposite sides together in a closed position. Other types of fasteners may be used, including, but not limited to: hook and loop fasteners (e.g. available under the trade name Velcro), adhesives, clasps, magnets and magnetic material (e.g. metals or metallics), string, or combinations thereof.

The internal void 1409 that extends along the length of the exterior body 1201 may be conveniently formed with the core in a collapsed condition by using a paper drill bit or similar device, or die cut. The shape of the internal void 1409 can be designed to suit the dimensions of the internal structure 1401.

In an example embodiment, the exterior body 1202 has the characteristics of a flexible article described in U.S. Pat. No. 9,512,615, titled "Flexible Furniture System", and incorporated herein by reference.

The internal structure 1401 includes an upper flange 1404, a web 1403 and a lower flange 1405. Two rows of lights 1402 are positioned on both sides of the web 1403. The lower flange 1405 is a translucent material. The upper flange 1404 is opaque and is powder coated, or textured in another manner, to diffuse the light.

In an example embodiment, the exterior body 1202 is a white translucent material, the upper flange 1404 and the web 1403 are painted with a white powder coating, and the lower flange 1405 is a white translucent material. It will be appreciated that other colors can be used.

A kit of parts of the lighting system 1201 is very easy to pack for storage and shipment, and is easy to assemble. As shown in FIG. 15*b*, the kit of parts includes the exterior body 1202, which is shown in a collapsed to small size so that it is easy for transport and storage. The kit of parts also includes the rigid internal supporting structure 1401, shown in a top-down view. The structure 1401 is preferably robust and not easily damaged. Furthermore, as the lights are located towards the middle of the internal supporting structure on the web 1403, the upper and the lower flanges offer some protection to the lights from objects that may knock against the internal supporting structure 1401. Other hardware (e.g. hanging wires, cables, support arms, power supply with wires, etc.) can also be included in the kits of parts.

In assembly, the collapsed exterior body is put over the structure 1401, and one or both ends of the exterior body are pulled away from each other to extend the exterior body along the length of the structure. The end panels 1410 on opposite ends of the exterior body 1202 are closed.

In an alternative process to assemble the kit of parts, a first end panel of the collapsed exterior body is closed first. A first end of the internal structure 1401 is then placed into the void 1409, and it abuts the closed end of the void. The second end of the collapsed exterior body is then pulled along the length of the internal structure 1401, until it passes over the second end of the internal structure 1401. Afterwards, the second end panel of the exterior body, which is now extended, is closed, which in turn, encloses the internal structure 1401.

Other approaches of assembling the lighting system 1201 can also be used.

Figure 17:
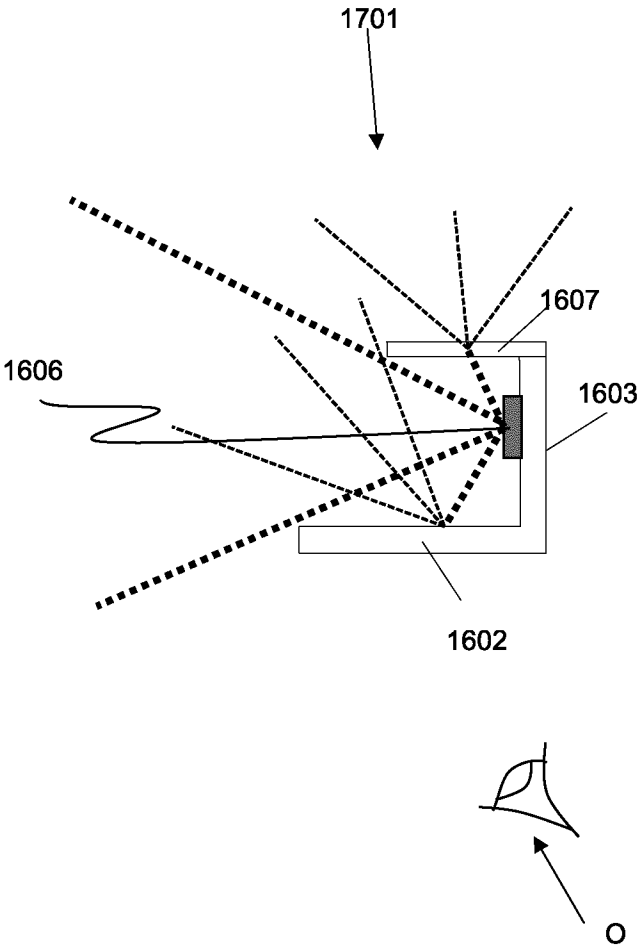
FIG. 17 is a front view or a rear view of an internal structure according to another example embodiment. The internal structure of FIG. 17 is oriented upside-down relative to the example embodiment shown in FIG. 16.
Figure 16:
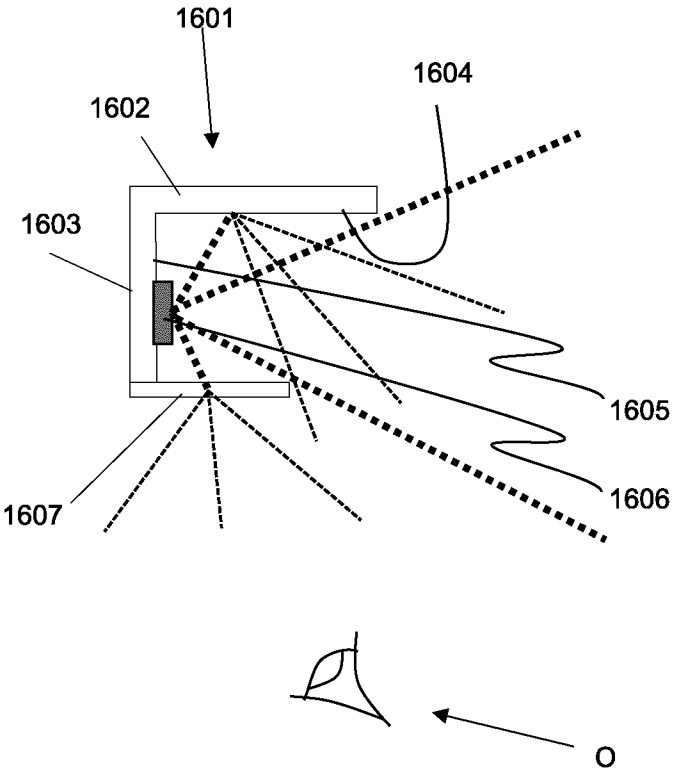
FIG. 16 is a front view or rear view of a C-shaped internal structure, including a translucent surface, according to an example embodiment.

Turning to FIGS. 16 and 17, internal supporting structures 1601 and 1701 having a C-shaped beam or channel are shown.

In FIG. 16, the structure 1601 includes an upper flange 1602 and a web 1603 positioned to the side of the upper flange. For example, the upper flange and the web are unitary is an L-shaped beam. A lower flange 1607 is mounted below the web 1603. The upper flange 1604 is opaque and its lower surface 1604 is textured. Lights or a light 1606 is mounted to the side surface 1605 that is on the same side as the upper flange 1602 and the lower flange 1607. The lower flange 1607 is translucent. The lower flange is also shown to have a shorter width than the upper flange. However, in other example embodiments, the lower flange width can be longer or the same as the upper flange.

FIG. 17 shows the structure 1701, which is similar to the structure 1601, but oriented upside down.

Figure 19:
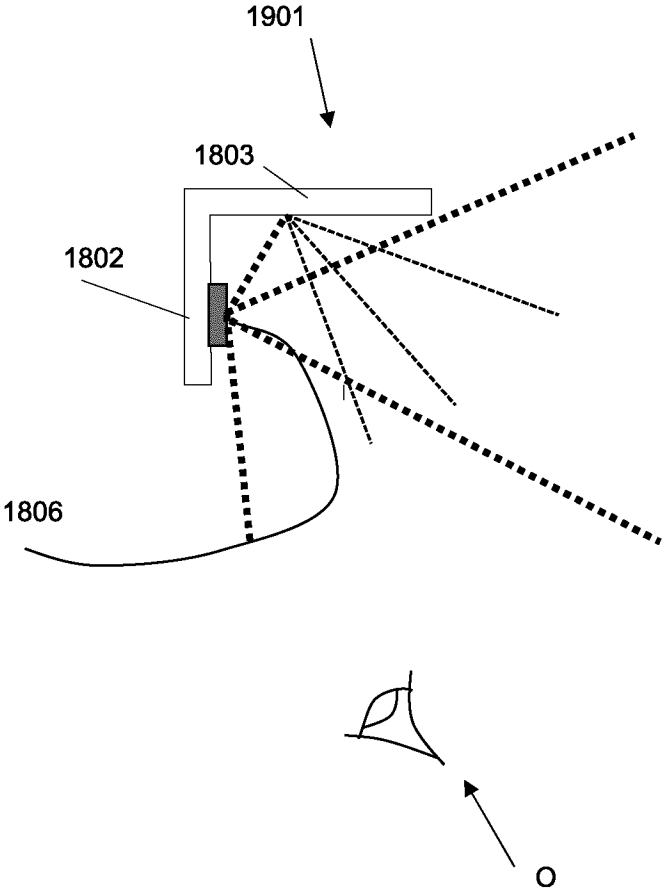
FIG. 19 is a front view or a rear view of an internal structure according to another example embodiment. The internal structure of FIG. 19 is oriented upside-down relative to the example embodiment shown in FIG. 18.
Figure 18:
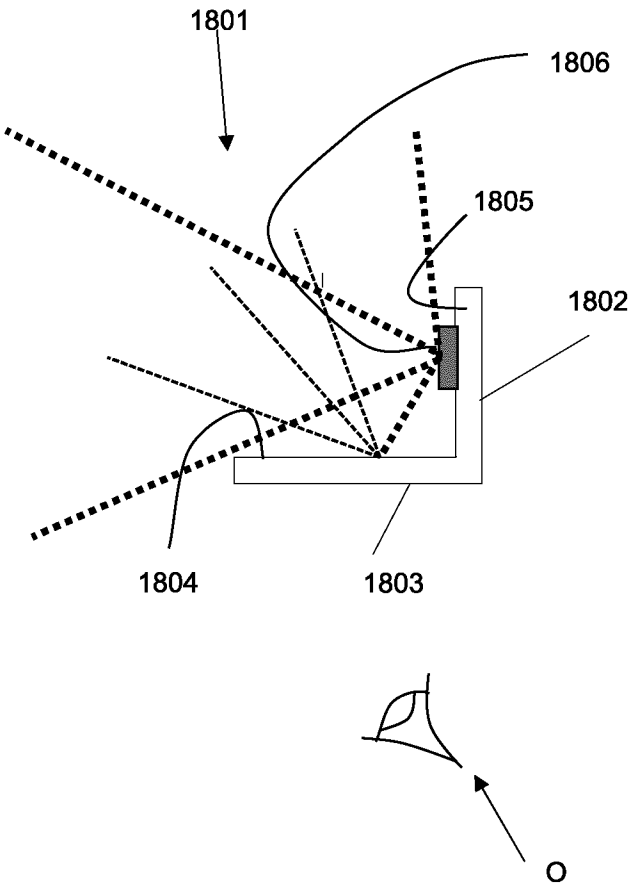
FIG. 18 is a front view or a rear view of an L-shaped internal structure that includes a diffusive reflective surface, according to another example embodiment.

FIGS. 18 and 19 show internal supporting structures 1801 and 1901 that have an L-shaped beam. The structure 1901 is oriented upside down relative to the structure 1801.

The web 1802 and the flange 1803 are unitary, or they are separate pieces. A light or lights 1806 are mounted on the side surface 1805 of the web 1802 that faces the direction to which the flange 1803 extends. The surface 1804 of the flange 1803 is textured to diffuse the light.

Figure 21:
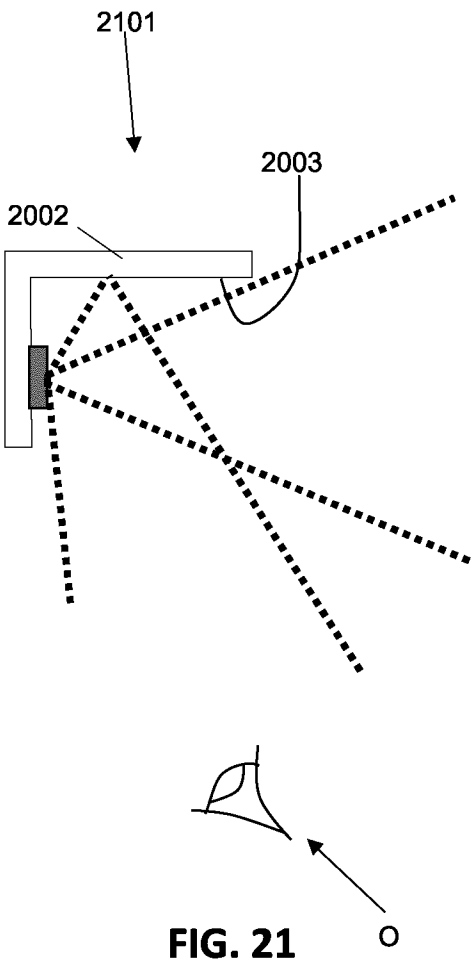
FIG. 21 is a front view or a rear view of an internal structure according to another example embodiment. The internal structure of FIG. 21 is oriented upside-down relative to the example embodiment shown in FIG. 20.
Figure 20:
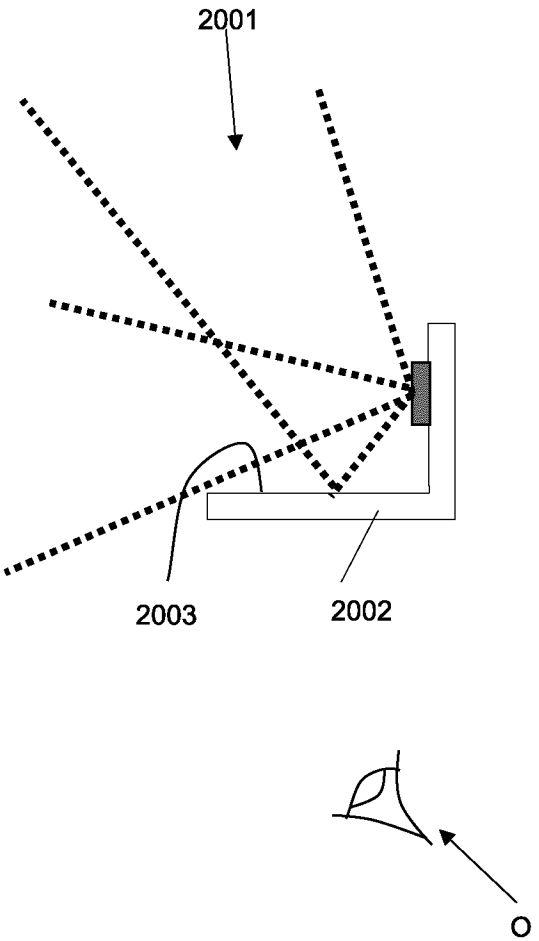
FIG. 20 is a front view or a rear view of an L-shaped internal structure that includes a reflective surface that is relatively less diffusive compared to the surface in FIG. 18.

FIGS. 20 and 21 also show L-shaped beams for the internal supporting structures 2001, 2101. However, the surface 2003 of the flange 2002 is reflective (e.g. a mirror, or like a mirror).

Figure 22:
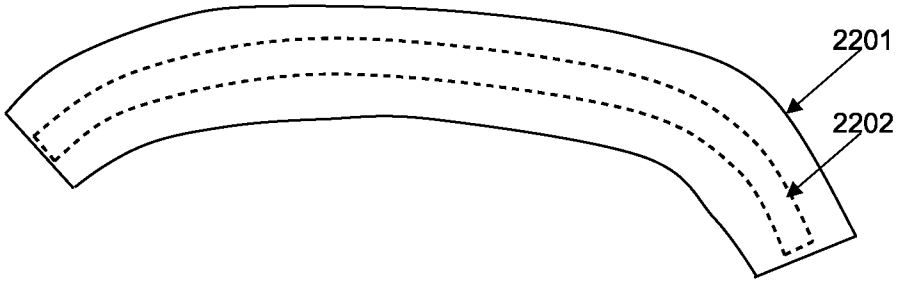
FIG. 22 is a top view of a lighting system showing an internal structure according to an example shape.

FIG. 22 shows, from a top-down view, an example of a curved internal support structure 2202 positioned within an exterior body 2201 that is also curved. In other words, the internal support structure does not have to be linear or straight. It can include curves, bends, angles, or combinations thereof. These curves, bends and angles can be oriented along different axes to make more complex three-dimensional shapes.

Figure 23:
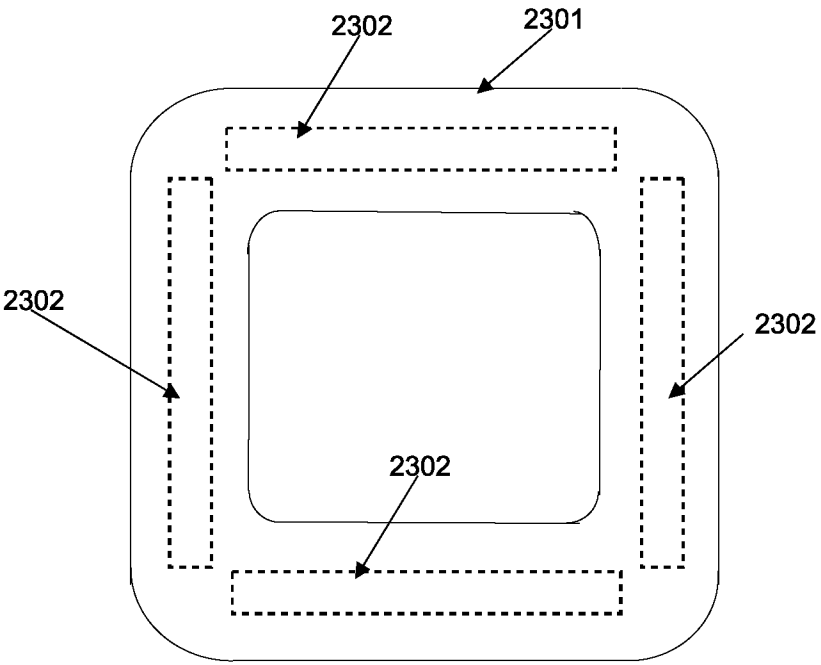
FIG. 23 is a top view of a lighting system showing multiple internal structures, according to an example embodiment.

FIG. 23 shows, from a top-down view, multiple internal support structures 2302 that positioned within an exterior body 2301. In an example aspect, the structures 2302 are spaced apart from each other. The structures 2302 are angled relative to each other. In the example shown, four internal support structures 2302 form four sides of a square.

In other examples, not shown, the multiple internal support structures are connected to each other. The structures can also be linear to form a very long support structure.

In a preferred example embodiment, the exterior body 2201 or the exterior body 2301 (or both) is formed from a collapsible and expandable exterior body as described with respect to the exterior body 1202, or multiple ones of such collapsible and expandable exterior bodies. In other words, the exterior body can flex around a curve as it is extended. Also, using fasteners (e.g. magnets or other types of fasteners) located at the end panels, multiple exterior bodies can be fastened together to form a large and continuous-looking loop as shown in FIG. 23.

In another example, the exterior body 2201 or the exterior body 2301, or both, are not flexible and are custom made to match the shape of one or more internal supporting structures.

Figure 24:
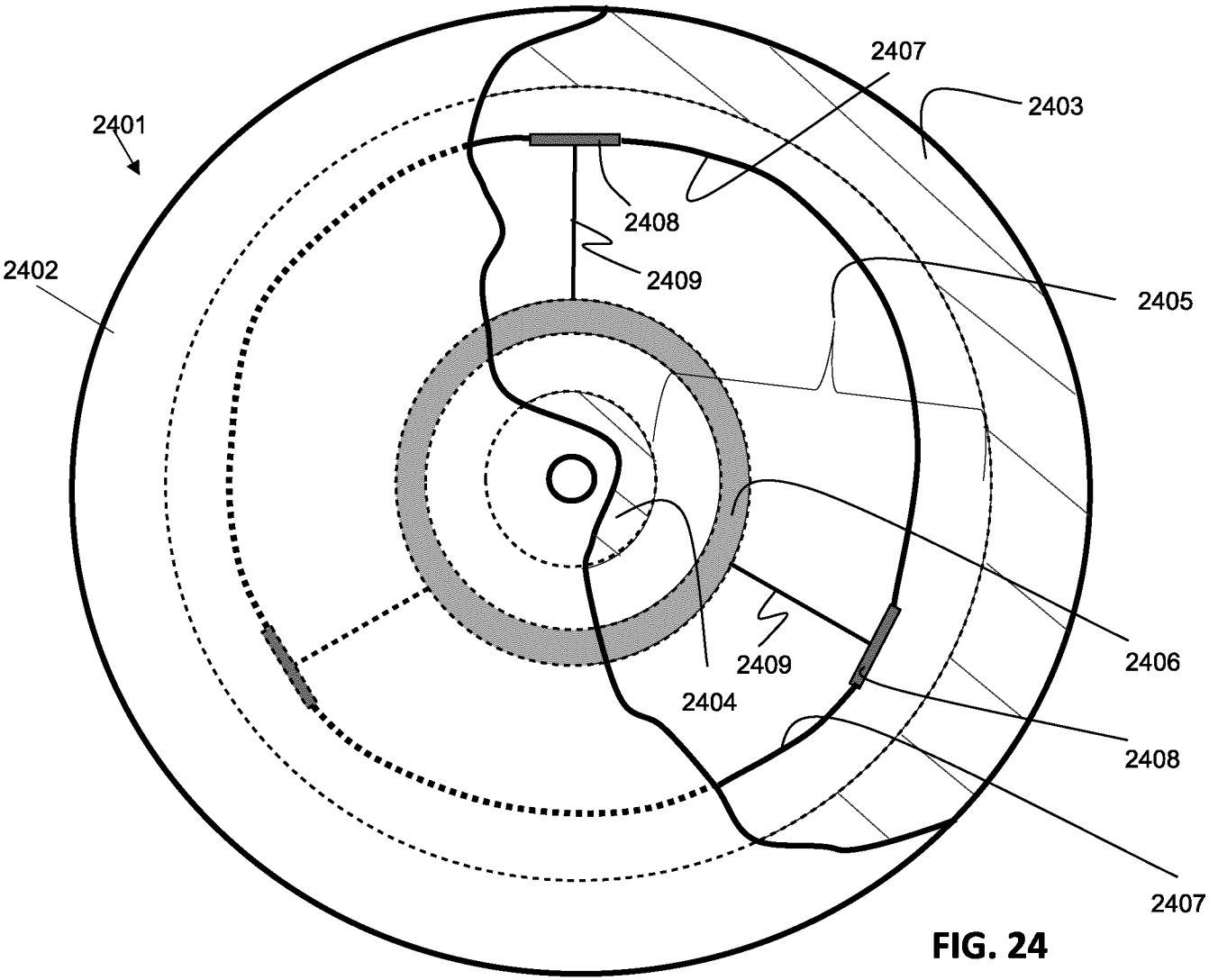
FIG. 24 is a top view of a torus shaped lighting system including a cutaway that shows an internal structure and connected armature within a cavity of a light shade.

FIG. 24 shows a top-down view of another example lighting system 2401 that is circular shaped. In an example embodiment, it is shaped as a torus. The lighting system includes an exterior body 2402 and an internal supporting structure 2404 positioned within an internal void 2405 of the exterior body 2402. The internal supporting structure 2406 is rigid or semi-rigid and has lights positioned on it. As can be seen from the top-down view, the structure 2406 is also circular and extends along the circular void 2405. The cross-sectional view of the supporting structure 2406 can be the same or similar to the front or rear views of the various internal supporting structures described herein (e.g. having one or more flanges, a web, and one or multiple lights arranged in seriatim extending along the structure).

A partial cut-away view shows an outer wall 2403 and an inner wall 2404 of the exterior body 2402, which define in part the internal void 2405.

An outer ring formed by one or more rods 2407 has a larger radius than the internal supporting structure 2404. The outer ring is connected to the internal supporting structure by connection pieces 2409. The outer ring, the connection pieces 2409, and the internal supporting structure 2404 are all positioned within the void 2405.

In a preferred example embodiment, there are multiple rods 2407 that are connected together by joints 2408. Each of the rods 2407, in a relaxed condition, is straight, but can be flexed to form an arc as shown in FIG. 24. Preferably, the rods are resiliently flexible or resiliently deformable. In other words, the rods 2407 can be dismantled from the joints 2408 and the rods will resiliently return back to its relaxed condition (i.e. straight). These rods, when attached at their ends using the joints 2408, form a taught outer ring that has some flexibility. The joints 2408 are, for example, rigid and straight and the opposite ends of each joint connect to an end of a rod. Furthermore, the connection pieces 2409 are wires, string or cable that are pulled taught between the internal support structure 2406 and the outer ring. The tension along the connection pieces 2409 can vary according the desired look or appearance of the light system 2401. The connection pieces 2409 are connected to the joints 2408. In particular, a given string, wire or cable is connected to a side of a given joint 2408 and, preferably, although not necessarily, is connected to a mid-way point along the length of the given joint 2408.

In an example embodiment, the rods 2407 and the internal supporting structure 2404 are the same color as the exterior body 2402. Thus, if the exterior body has holes on its bottom surface, and when a person looks up at the lighting system, it will be difficult to visually notice the rods and the internal supporting structure within the exterior body.

In an alternative example embodiment, the rods 2407 are rigid and permanently have a curved shape. In another alternative embodiment, a single rod structure is used to form an outer ring. In another alternative embodiment, the connection pieces 2409 are rigid or semi-rigid rods.

Although not shown, supports (e.g. wires, strings, rods, etc.) can be used to hang the light system 2401 from above. For example, wires, string, rods, etc. can be attached to the joints 2408, or the internal support structure 2406, or the exterior body 2402, or the connection pieces 2409, or a combination thereof.

Alternatively, supports (e.g. rods) can be used to support the light system 2401 from below.

Figure 25:
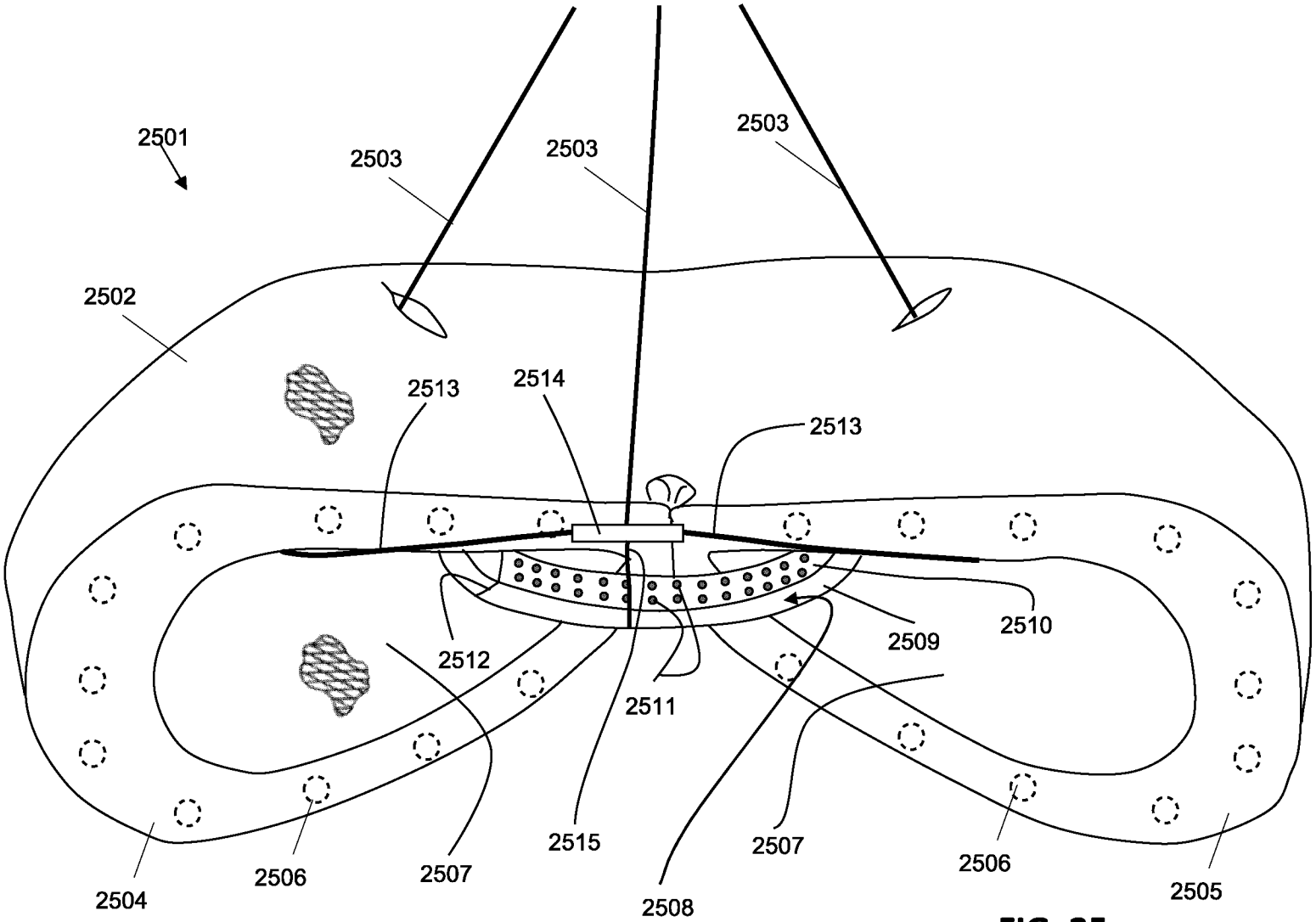
FIG. 25 is a perspective view of an example embodiment a torus shaped lighting system that is partially opened to show an internal structure and connected armature within a cavity of a light shade.
Figure 26:
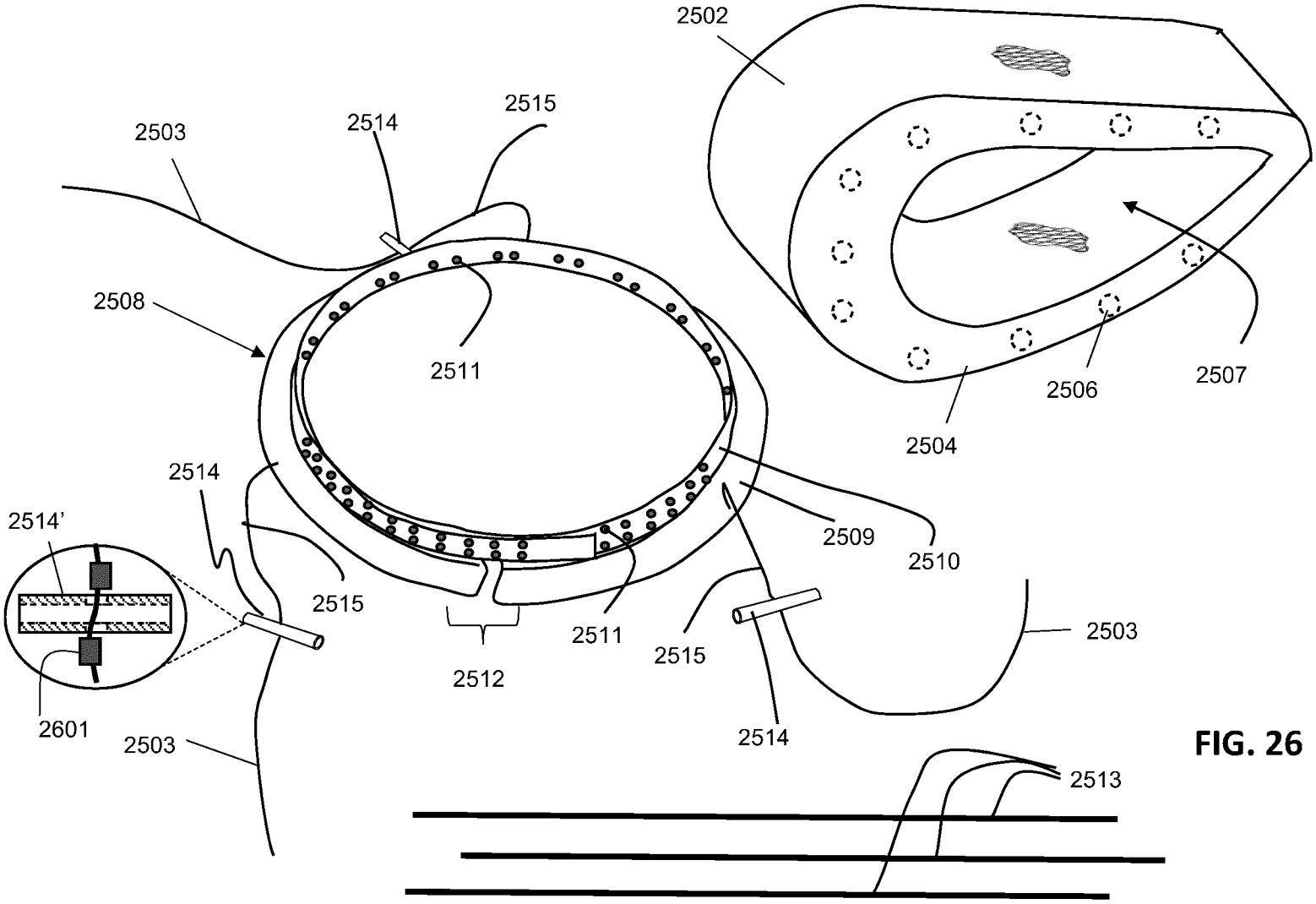
FIG. 26 shows a kit of parts used to form the lighting system of FIG. 25.

FIGS. 25 and 26 show another example embodiment of a torus shaped lighting system 2501. FIG. 25 shows an assembled lighting system 2501 with the exterior body 2502 partly opened to show internal components, and FIG. 26 shows an unassembled kit of parts used to form the lighting system 2501.

In FIG. 25, the exterior body 2502 is partially opened. The exterior body 2502 is made of different panels that can be compressed together and extended apart from each other. There are vertical voids between the panels. This is similar to the collapsible and expandable exterior body described with respect to the embodiment in FIGS. 12 to 15*a* and 15*b*, although the shape is different. When the exterior body 2502 is fully closed, the end panel surfaces 2504 and 2505 abut each other and can be fastened to each other using magnets 2506. In the closed state, the exterior body 2502 forms a circle. The magnets are, for example, embedded or covered by the end panels 2504 and 2505. In the expanded state, a void 2507 is formed within the exterior body. The void 2507 is also circle-shaped when the exterior body 2505 is flexed to form a circle.

As can be seen in FIG. 25, the internal supporting structure 2508 is positioned within the circle-shaped void 2507. The structure 2508 has an L-shaped cross section, which includes a web 2510 and a lower flange 2509 extending outwards from the web 2510. Lights 2511 (e.g. LEDs, OLEDs, etc.) or a long strip of light are positioned on the outward facing side of the web 2510. As can be seen in FIG. 26, lights 2511 are also positioned on the inward facing side of the web 2510. In the example shown, there are more lights positioned on the outward facing side of the web 2510 relative to the number of lights positioned on the inward facing side of the web 2510. More generally, there is a greater light output (e.g. measurable in lumens) from the light or lights that are positioned on the outward facing side compared to the light output from the light or lights that are positioned on the inward facing side. In another example, there are no lights positioned on the inward facing side of the web.

The lower flange 2509 helps to diffuse the light. In an example embodiment, the lower flange 2509 is opaque and has a matte or textured surface finish. As a person, located below the lighting system 2501, looks upwards through the holes in the exterior body 2502, the person cannot directly see the light sources since they are visually obstructed by the lower flange 2509. It will be appreciated that other configurations of internal supporting structures can be used in the torus shaped lighting system 2501.

Continuing with FIG. 25, flexible rods 2513 are connected at their ends to joints 2514, which together form an outer ring. The outer ring is semi-rigid so as to give the lighting system 2501 a wavy shape, like a cloud. In particular, each joint 2514 is a rigid body with hollowed ends, which respectively receive and hold the ends of two separate flexible rods 2513. In total, there are three flexible rods and three joints 2514 which are used to form the outer ring. Connection wires or strings 2515 respectively connect each joint 2514 to the internal supporting structure 2508. Hanging wires 2503, in turn, are respectively connected to each of the joints 2514.

In an example embodiment, a hanging wire 2503 and a connection wire 2515 connected to a common joint 2514' are in fact a single wire (e.g. both 2503 and 2515 are a single wire) that is threaded through the width of the joint 2514'. The example of the joint 2514' is shown in FIG. 26 in a cross-sectional view along the length of the joint. For example, to fabricate the joint 2514', a tube is provided that can receive the ends of two rods. The major axis of the tube coincides with the elongate void in the tube. A hole is drilled through the tube, midway along its length, and the drill hole is made orthogonal to the major axis of the tube. This orthogonal hole can be made in other ways other than drilling. The single wire is then threaded through this orthogonal hole and the joint can be held in place along the length of the single wire by clasps 2601 attached to the single wire.

As can be seen in FIG. 25, the hanging wires 2503 pull up on the joints 2514, and the flexible rods 2513 slightly sag between the joints 2514 due to the weight to the exterior body 2502 resting on the rods 2513. This creates peaks and valleys, or undulations, giving the light system 2501 the visual effect of looking like a cloud. The thin profile of the rods 2513, the joints 2514 and the connection wires or strings 2515 reduces the surface area of the outer ring and, therefore, reduces the shadow being cast by the outer ring. In other words, the outer ring obstructs very little light being emitted from the lights 2511.

A split or gap 2512 can be formed between the ends of the internal supporting structure 2508 (e.g. which is an inner ring). Or, the ends can overlap to form a continuous circle. The split 2512 in the internal supporting structure 2508 allows for the structure 2508 to be pass through the void 2507 of the exterior body 2502. The ends of the internal supporting structure can be secured or held together using a band, an adhesive, or some other type of fastener.

As can be better seen in FIG. 26, in the kit of parts, the flexible rods 2513 are in a relaxed state and are straight. They are resiliently deformable and can be arched and then return back to a straight configuration. The rods 2513, for example, are made of carbon fiber, which is a light weight and fire-resistant material. More particularly, the rods 2513 are carbon fiber tubes. In FIG. 26, the exterior body 2502 is shown in a collapsed state, which is easy to transport and store.

In an example assembly process of the kit of parts, the ring-shaped internal supporting structure 2508 is first passed through the void 2507 of the collapsed exterior body 2502, using the split 2512 in the structure 2508. The ends of the rods 2513 are then inserted into the hollows of the joints 2514 to form the outer ring. The collapsed exterior body 2502 is then extended around the internal supporting structure 2508 and the outer ring to form a torus.

Figure 27:
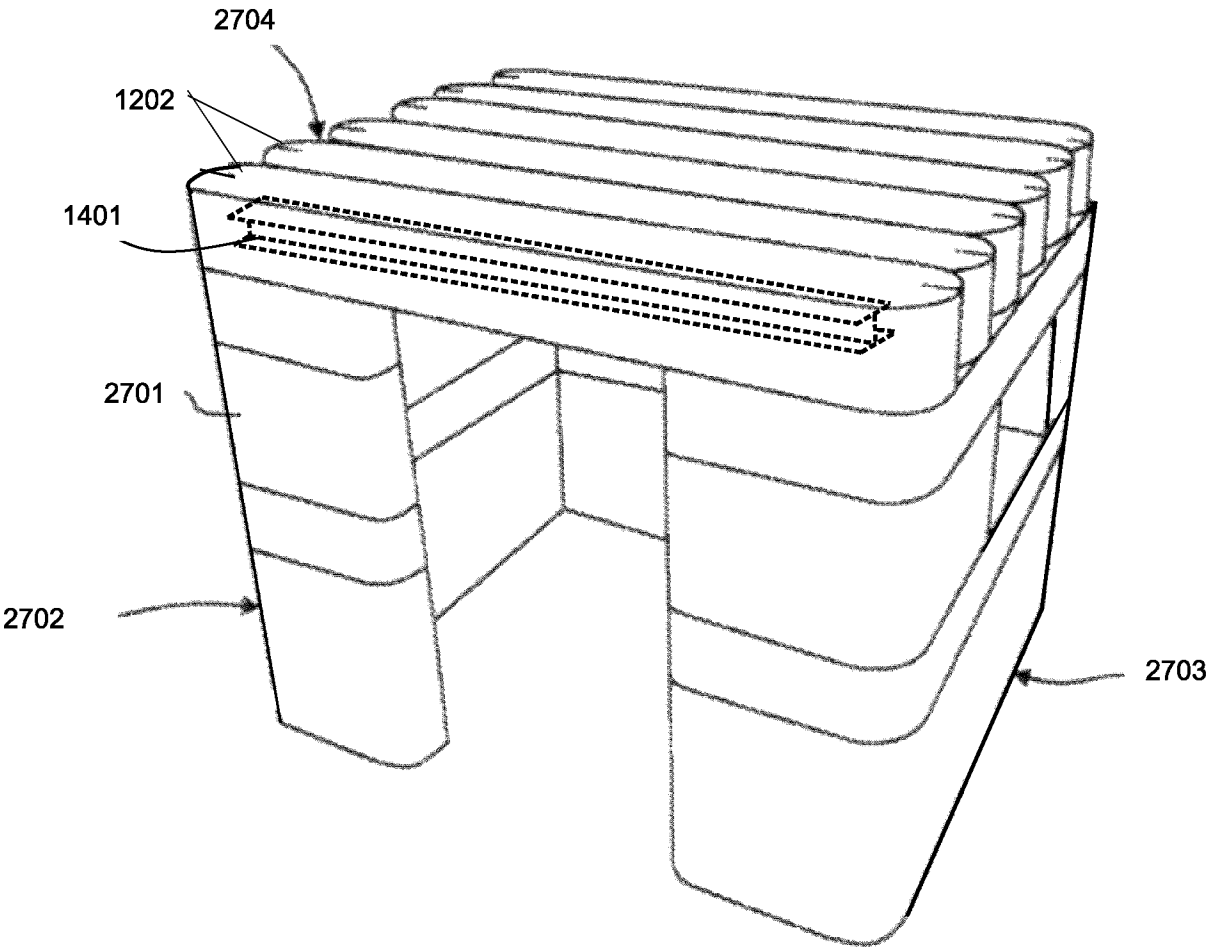
FIG. 27 is a perspective view of a building assembled from partitions, according to another example embodiment.

Turning to FIG. 27, partitions 2701 may be used to form a cubicle or room 2702, such as may be desired as a temporary structure at a trade show or to provide a degree of privacy within an open area. The room 2701 has walls 2703 formed from stacked partitions. Other ways of forming walls or assembling walls 2703 can be used.

Figure 28:
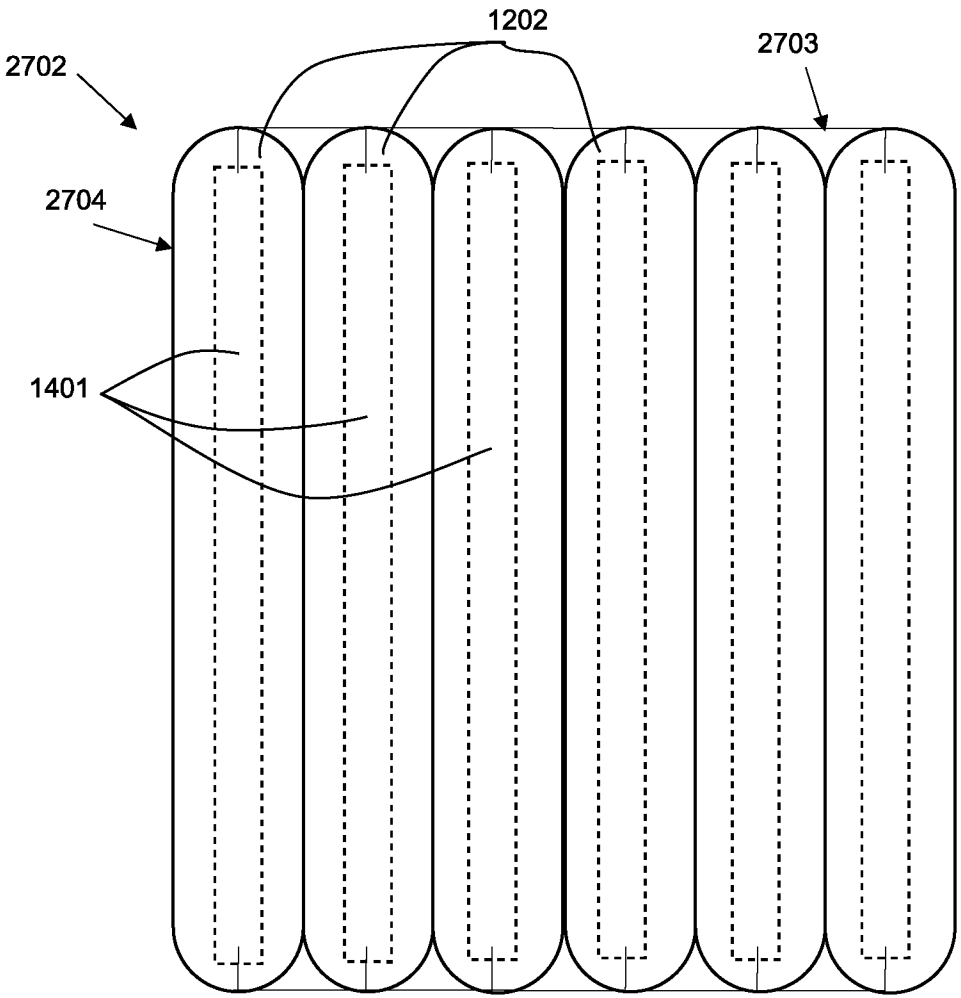
FIG. 28 is a top view of the building shown in FIG. 27, further showing the internal structures in the ceiling components.

As better seen from the top-down view in FIG. 28, a roof structure 2704 is formed by a series of individual exterior bodies 1202 each having an internal supporting structure (e.g. the structure 1401, or some other configuration of an internal supporting structure) that provides ceiling lighting. The internal supporting structures act as beams that span across the ceiling of the room 2702, and also include embedded lighting. This provides a very pleasantly diffused lighting environment within the room, which is pleasant even when a person looks up at the ceiling.

FIGS. 29*a*, 29*b*, 30*a*, 30*b*, 31*a* and 31*b* show other example configurations of internal supporting structures.

Figure 29B:
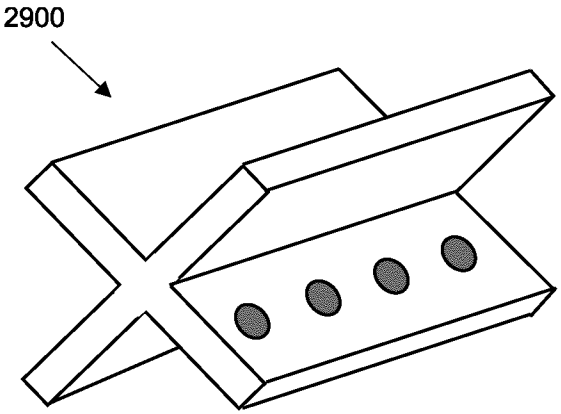
FIGS. 29*a* and 29*b* respectively show a front view or rear view of an X-shaped internal structure and a perspective view of the X-shaped internal structure, according to another example embodiment.
Figure 29A:
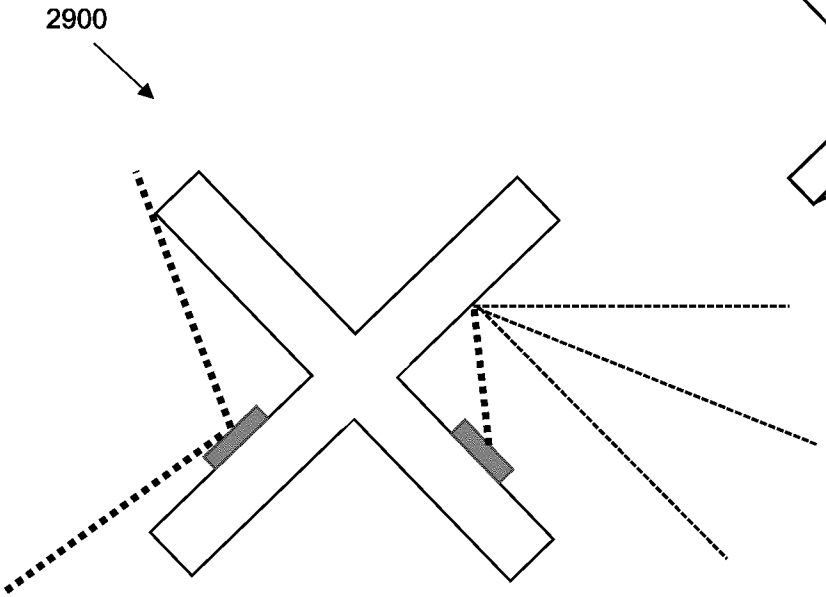

In FIGS. 29*a* and 29*b*, the internal supporting structure 2900 has four flanges that are angled relative to each other to form an X-shape. The lights are located on the lower flanges and the surfaces of the flanges are, for example, textured or matte to scatter the light rays. In an alternative example, the structure 2900 is oriented upside down.

Figures 30A, 30B:
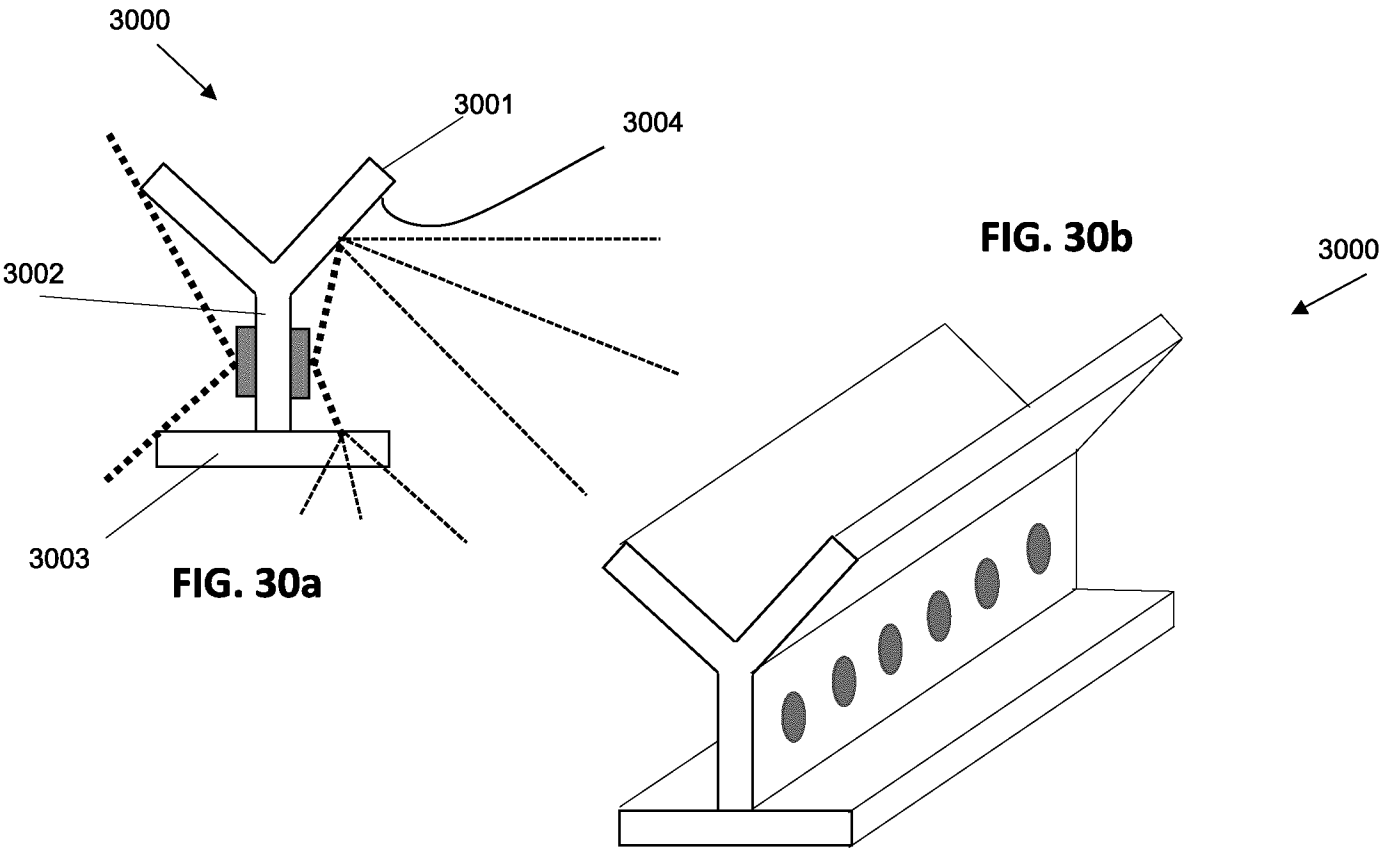
FIGS. 30*a* and 30*b* respectively show a front view or rear view of an internal structure with a Y-shaped upper flange and a perspective view of the same internal structure, according to another example embodiment.

FIGS. 30*a* and 30*b* show an internal supporting structure 3000 that has a Y-shaped upper flange 3001, a web 3002, and a horizontal lower flange 3003. The lights are located on the web 3002, and light rays that pass through the translucent material of the lower flange 3003 are diffused. The light rays that reflect off the lower surface 3004 of the Y-shaped flange 3001, which has a textured or matte surface, are diffused at a greater outward angle, compared to a horizontal upper flange.

Figure 31B:
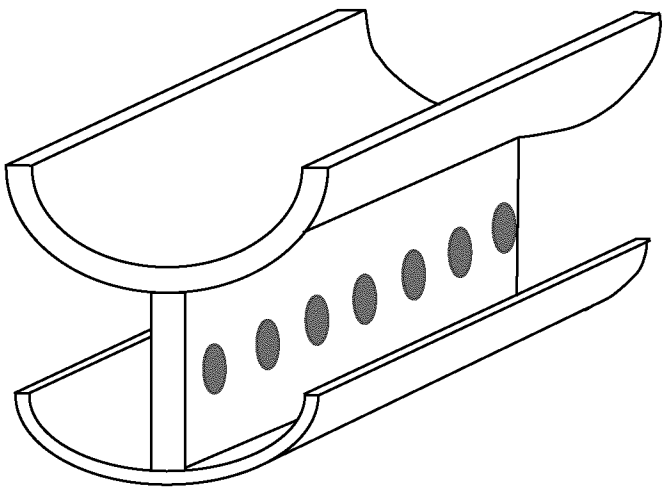
FIGS. 31*a* and 31*b* respectively show a front view or rear view of an internal structure with a U-shaped upper flange and a U-shaped lower flange, and a perspective view of the same internal structure, according to another example embodiment.
Figure 31A:
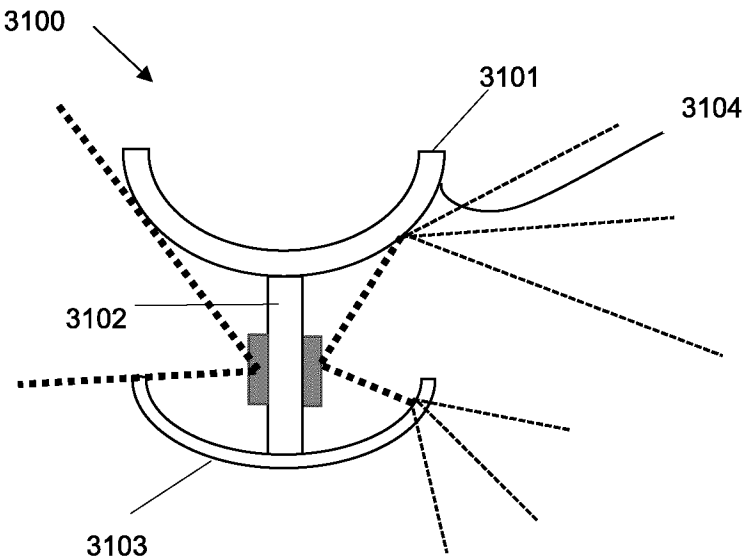

FIGS. 31*a* and 31*b* show an internal supporting structure 3100 that has a U-shaped upper flange 3101, a web 3102, and a U-shaped lower flange 3103. The lights are located on the web 3102, and light rays that pass through the translucent material of the lower flange 3103 are diffused. As a person or observer, underneath the lighting system, is located at a further distance to the left or the right of the lighting system, the U-shaped lower flange 3103 is able to still diffuse the light. The light rays that reflect off the lower surface 3104 of the U-shaped flange 3101, which has a textured or matte surface, are diffused at a greater outward angle, compared to a horizontal upper flange.

It will be appreciated that the shape of the upper flange or the shape of the lower flange, or both, can vary from a horizontal surface in order to provide different angles of light reflection and diffusion.

Figure 32:
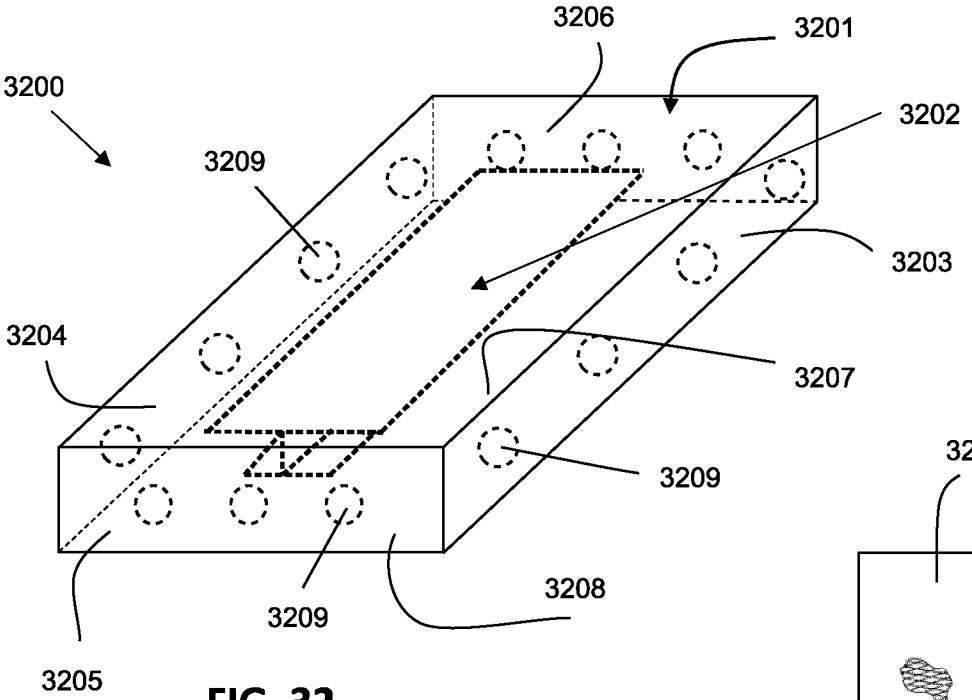
FIG. 32 is a perspective view of a lighting panel including an internal structure inside the lighting panel, and having fasteners positioned on its side surfaces.
Figure 33:
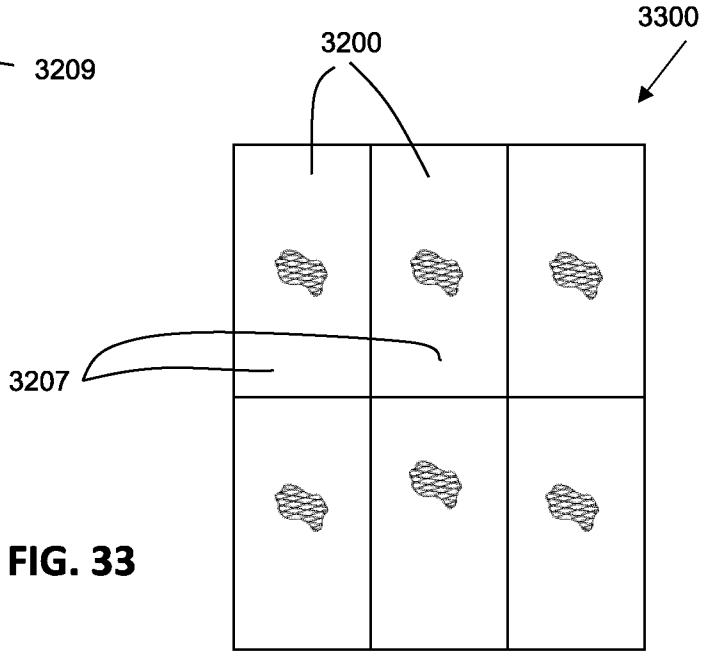
FIG. 33 is a top view of multiple ones of the lighting panels of FIG. 32 fastened together to form a light panel surface.

Turning to FIG. 32, another example embodiment of a lighting system is shown in the form of a lighting panel 3200. The lighting panel 3200 includes an exterior body 3201 and an internal supporting structure 3202 positioned within a void of the exterior body. Although not shown, there are lights positioned on the internal supporting structure 3202. Side walls 3203, 3204, 3205, 3206 each have fasteners 3209 to allow for fastening one lighting panel 3200 with another lighting panel 3200, as shown in FIG. 33. The fasteners are preferably magnetic based materials that are embedded in the side walls, or are covered with a covering material, or both. Other types of fasteners could be used, including, but not limited to, hook and loop fasteners under the tradename Velcro.

The upper and lower surfaces or walls 3207, 3208 of the exterior body 3201 preferably have holes. In an example embodiment, there are vertical channels that extend from the upper surface 3207 to the lower surface 3208, and the aggregate of the walls or material that form these vertical channels also form the exterior body 3201.

As shown in FIG. 33, a system 3300 of connected lighting panels 3200 is shown from the top view. These panels are connected by the fasteners. These panels can be used to form a larger lighting surface for a ceiling. For example, the system 3300 can be used to conveniently form drop ceilings or hanging ceilings, which includes integrated diffused lighting.

Figure 34:
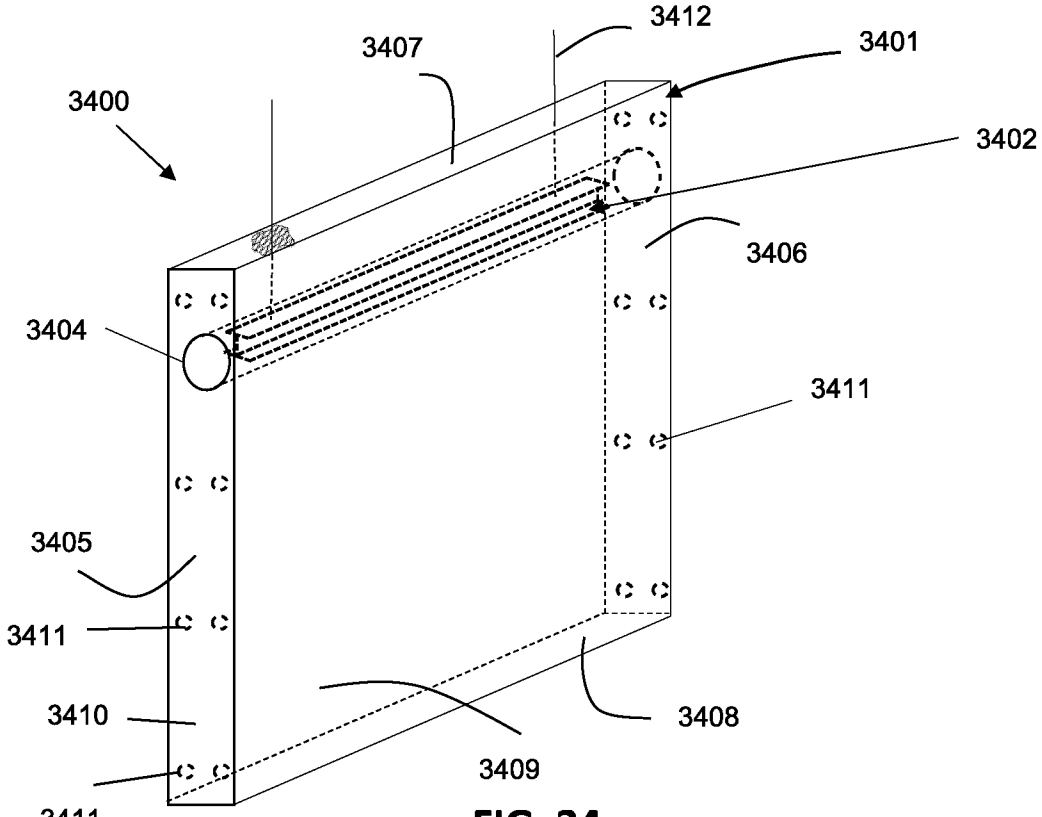
FIG. 34 is a perspective view of a vertically oriented lighting panel having an internal structure positioned within the lighting panel.

FIG. 34 shows another lighting system in the form of a lighting wall 3400. The lighting wall 3400 includes an exterior body 3401 that includes a passage 3404 or void defined therein, and extending along the horizontal length of the external body from the end surface 3405 to the end surface 3406. Within the passage 3404 is an internal supporting structure 3402 that has integrated lighting. In the example shown, the passage 3404 is located in the upper portion of the lighting wall 3400, and the entire lighting wall 3400 is hung by wires 3412 attached to the internal supporting structure 3402. By having the passage 3404 and the internal supporting structure 3402 positioned in the upper portion of the wall 3400, then the lower portion of the wall 3400 hangs downwards and the vertical orientation of the wall 3400 is maintained.

In another example, not shown, the passage 3404 and the internal supporting structure 3402 are positioned at a midway portion or at a lower portion of the lighting wall 3400. This would be useful for configuring the lighting wall 3400 to be free standing on a surface below (e.g. a ground surface). In this way, the center of gravity of the lighting wall is closer to the ground.

The exterior body 3401, for example, has multiple holes on the top surface 3407 and on the bottom surface 3408. There may be few or no holes on the side surfaces 3409 and 3410.

In another aspect, there are fasteners 3411 located on the end surfaces 3405 and 3406 that allow multiple instances of a lighting wall 3400 to be connected end-to-end, or in seriatim. Preferably the fasteners are magnetic material, but other types of fasteners can be used.

In another example aspect, the exterior body 3401 is a "softwall" or a "thinwall" sold by the company molo design, ltd.

Figure 35:
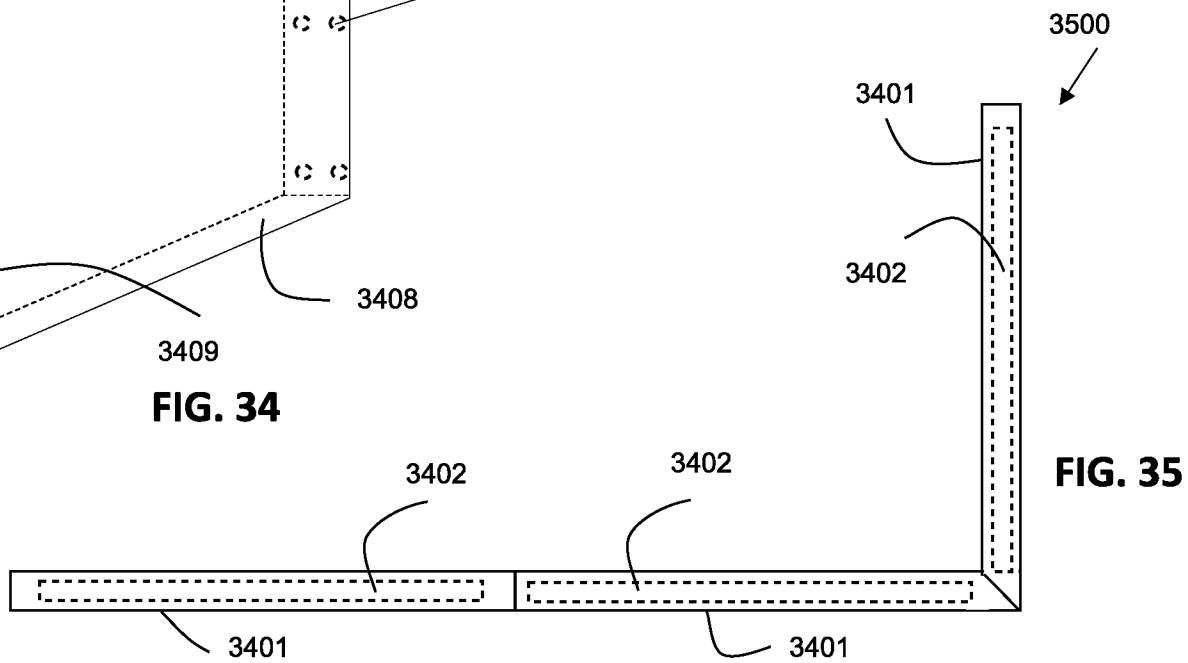
FIG. 35 is a top view of multiples ones of the vertically oriented lighting panels of FIG. 34 fastened together in seriatim.

FIG. 35 shows a top view of multiple lighting walls 3400 connected in seriatim to form a continuous wall 3500. In particular, two of the walls 3400 are connected linearly, while another two walls are connected at an angle. As can be seen in FIG. 35, there is a gap between the ends of the internal supporting structures 3401. As can also be seen, for the two walls connected at an angle, the connected end surfaces are angled so that they can be flush with each other. For example, this end surface of a "softwall" or a "thinwall" can be angled, since this type of exterior body is flexible.

FIG. 36 shows an angled connector 3600 for connecting two internal supporting structures in place. The connector includes two end faces 3601 and 3602, which both have a receiving cavity. As best seen on the end face 3602, the receiving cavity 3603 is shaped to have a complimentary profile of an end of an internal supporting structure. For example, if the internal supporting structure is shaped like an I-beam with an upper flange that is wider than a lower flange, then the receiving cavity 3603 is shaped to match it, or to be very similar to such a shape from an end-view of the I-beam. In this way, the end of the internal structure can be inserted into the receiving cavity 3603. If the internal supporting structure has another shape, like a C-beam, an L-beam, an X-beam, etc., then the receiving cavity is shaped to be complimentary.

Although the angled connector 3600 is shown to have approximately a 90 degree bend, it can be appreciated that other angles or curves can be used to create other configurations of connectors.

FIG. 37 shows a linear connector 3700, including an end face 3702 and a receiving cavity 3703.

FIG. 38 shows the continuous wall 3500, but now including a linear connector 3700 and an angled connector 3600 used to hold together and connect internal support structures 3402.

Figure 39:
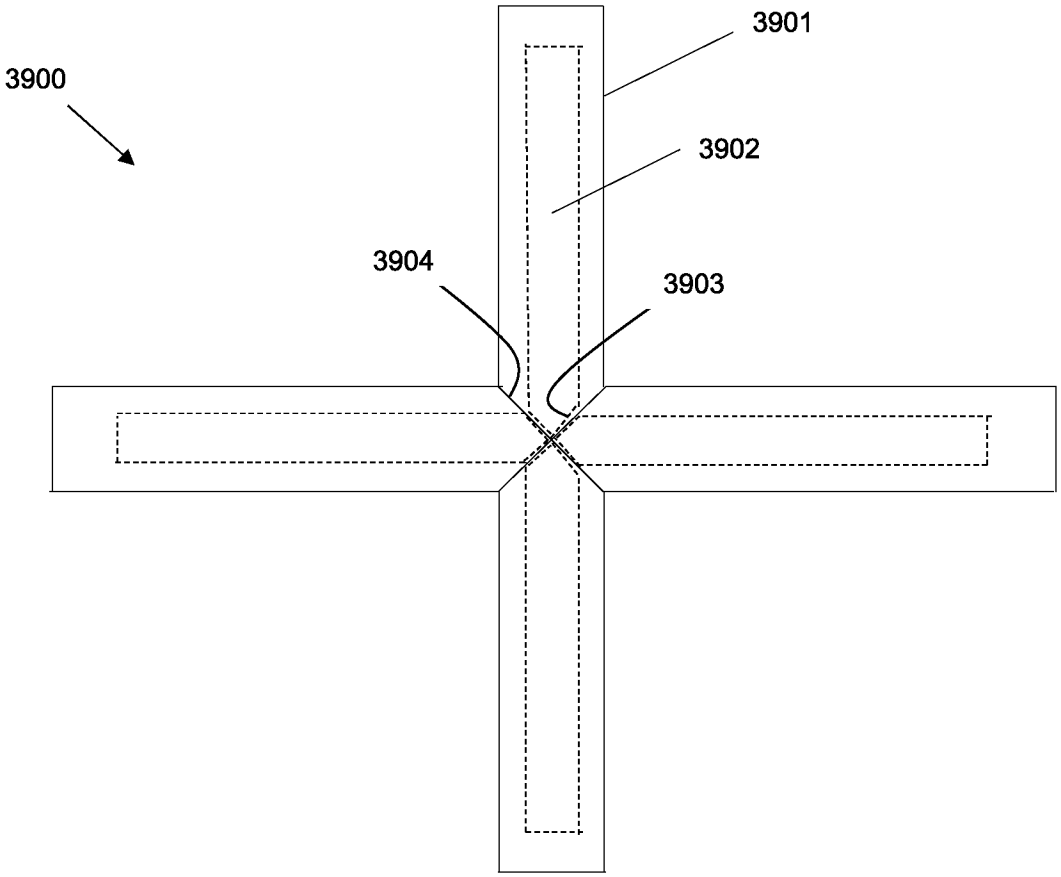
FIG. 39 is a top view of a lighting system including four exterior bodies that respectively have inside four internal structures, and these components are arranged to form a cross.

FIG. 39 shows a top view of a lighting system 3900 that includes four exterior bodies 3901 that are arranged in a cross configuration. Each of the exterior bodies have within it an internal supporting structure 3902.

In an example embodiment, an end 3903 of each of the internal supporting structure is beveled to form a peak. This allows for the ends of the internal supporting structures to be placed close together in a cross configuration. Similarly, an end 3904 of each exterior body is also angled to form a peak, so that the four exterior bodies can be joined together to form a cross.

In an example embodiment, the exterior body 3901 is the same as the exterior body 1202, described in FIGS. 12 to 15*b*. The left and the right portions 1407 and 1406 of an end panel 1410 are flexed backwards to form the peak, and the fasteners 1408 on one end panel connect to fasteners on another end panel.

Figure 40:
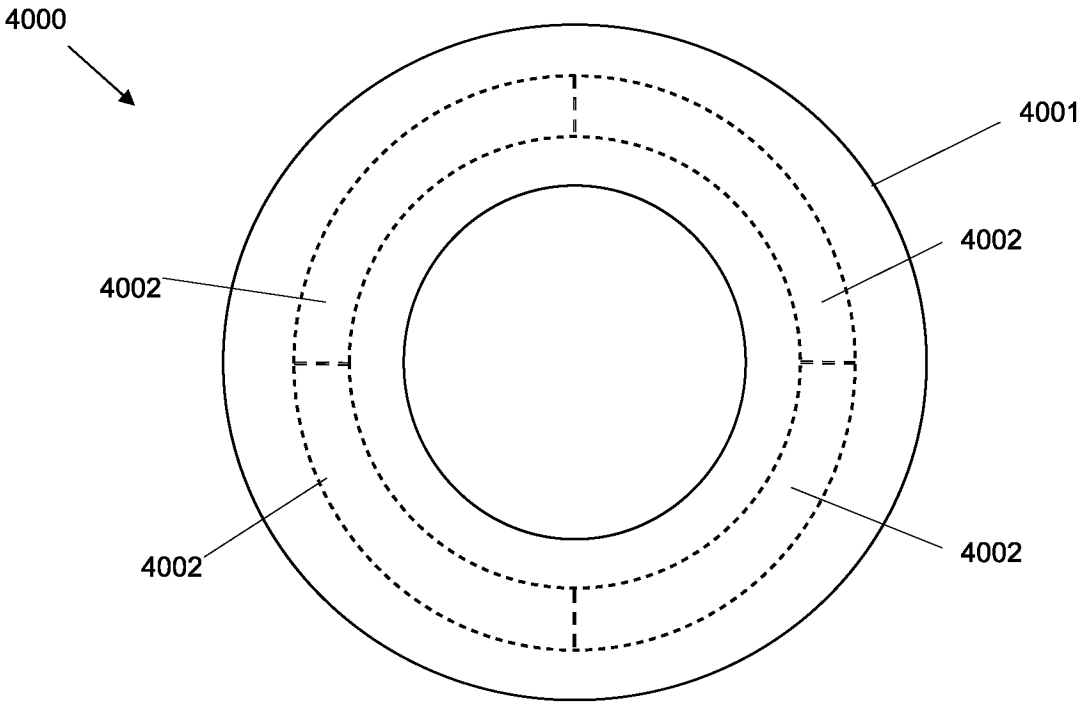
FIG. 40 is a top view of a lighting system including one or more exterior bodies that have inside four internal structures, and these components are arranged to form a circle.

FIG. 40 shows a top view of a lighting system 4000 that includes an exterior body 4001 having several curved internal supporting structures 4002 positioned therein. The system 4000 forms a circle.

In an example embodiment, the exterior body 4001 can formed from multiple smaller exterior bodies that are joined together. In another example embodiment, the one or more exterior bodies are the same as the exterior body 1202 described in FIGS. 12 to 15*b*. In other words, a flexible exterior body 1202 (or multiple instances of the body 1202 fastened together) encircle the internal supporting structures 4002.

Figure 41B:
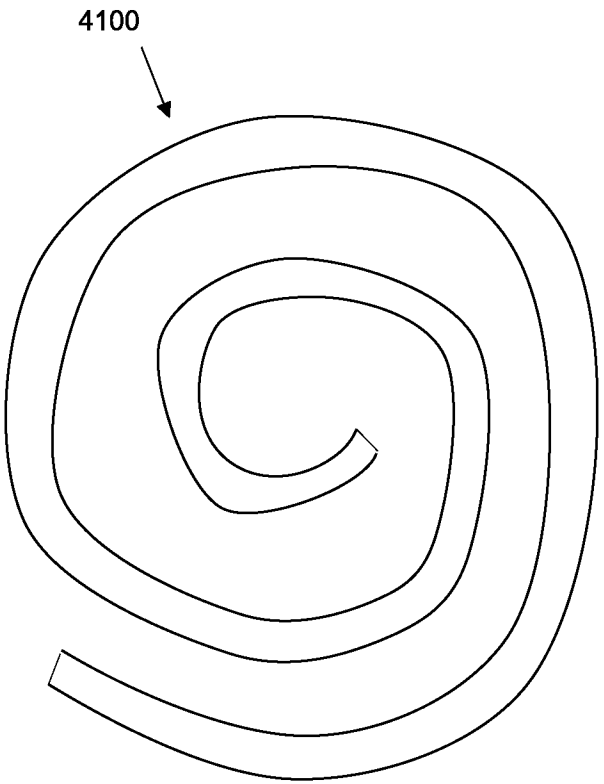
FIGS. 41*a* and 41*b* are respectively a side view and a top view of an internal structure in isolation, shaped as a conical helix.
Figure 41A:
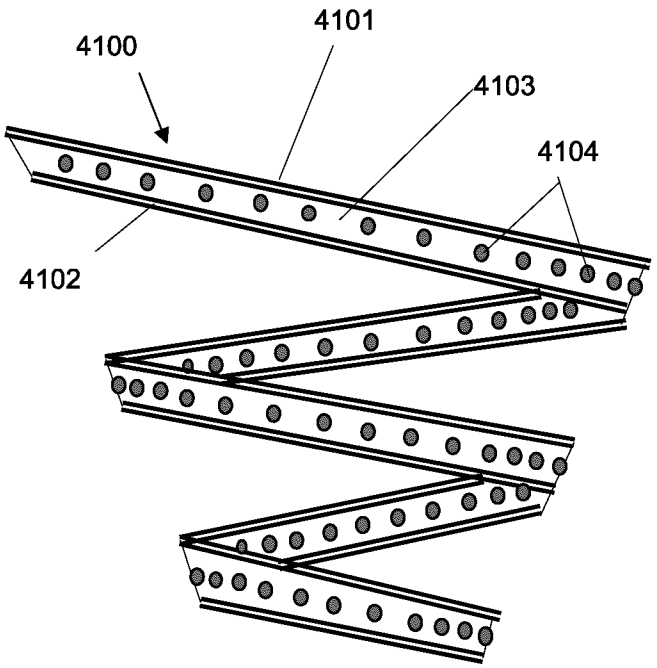

FIGS. 41*a* and 41*b* show the internal supporting structure 4100 in isolation. It has a conic helix shape. As can be seen from the side view in FIG. 41*a*, the structure 4100 includes an upper flange 4101, a web 4103 and a lower flange 4102. Lights 4104 are positioned on both sides of the web 4103.

A fabric covering can be used to cover the sides. Alternatively, one or more flexible exterior bodies 1202, as described in FIGS. 12 to 15*b*, can be used to cover the length of the structure 4100. If multiple flexible exterior bodies 1202 are used, it is appreciated that the exterior bodies 1202 are fastened together using fasteners 1408.

The internal supporting structure 4100 could be used, for example, to form a chandelier.

It is appreciated that the internal supporting structure 4100 can bend in three dimensions, along different axes, to create interesting design shapes, and while providing structural support and diffused lighting.

Figure 42:
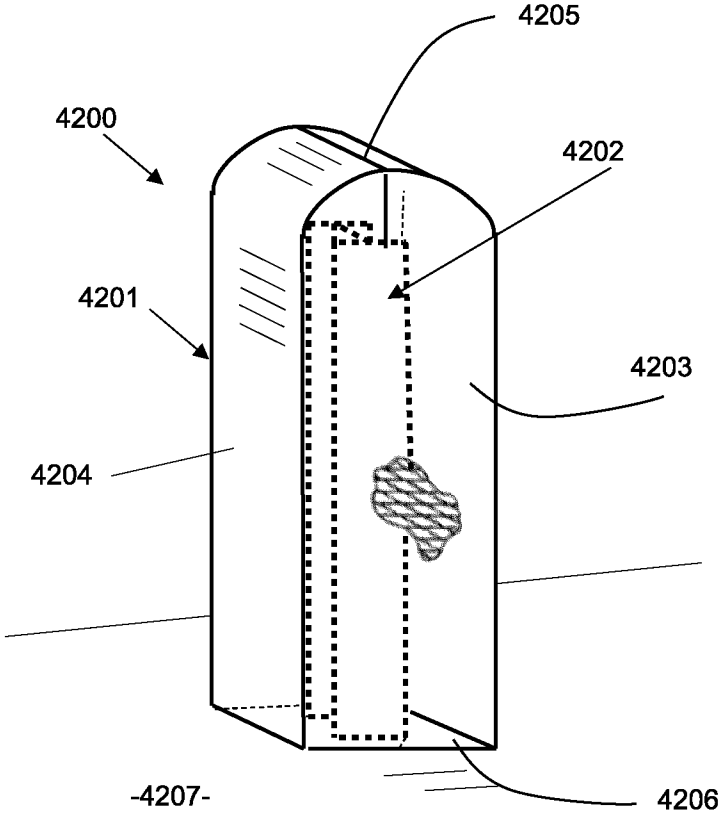
FIG. 42 is a perspective view of a vertically oriented lighting system that is self-supported and standing on a surface.

FIG. 42 shows another example embodiment of a lighting system 4205 that includes an exterior body 4201 and an internal supporting structure 4202 positioned inside the exterior body. The internal supporting structure 4202 is vertically oriented and is freestanding on a surface 4207 (e.g. a ground surface). For example, the combination of the flanges and the web support the internal supporting structure 4202 on its end. In an example embodiment, the internal supporting structure is shaped like an I-beam, as shown in the figure. However other configurations of the structure 4202 are possible.

The exterior body 4201 has a front surface 4203 and an opposite back surface that have holes. The internal support structure 4202 is oriented to that the flanges are positioned between the light and the holes, so that the lights are not directly visible through the holes. Preferably, the lights are positioned on the web of the internal support structure, although other positions are possible. The side surfaces 4204 of the exterior body do not have holes. It is appreciated that, in this vertical orientation, there is no "upper" flange or "lower flange", but simply one or more flanges that extend at an angle from a web.

In an example embodiment, the exterior body 4201 is the same as the exterior body 1201 described in FIGS. 12 to 15*b*. The top portion 4205 of the exterior body 4201 has an end panel that is folded closed, and the bottom portion 4206 has an end panel that is in the open position and rests on the ground surface 4207. The exterior body 4201 is held upright by the internal supporting structure 4202.

Figure 43:
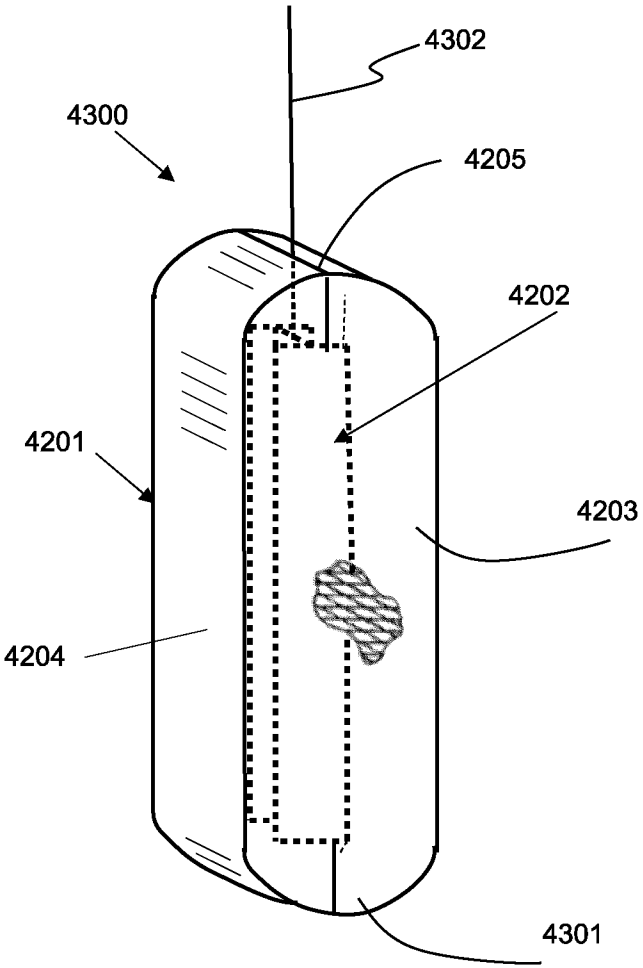
FIG. 43 is a perspective view of a vertically oriented lighting system that hangs from an overhead structure.

FIG. 43 shows a lighting system 4300, which is similar to 4200, but is arranged in a hanging configuration. The exterior body 4201 is similar, but the bottom portion 4301 has an end panel that is folded to be in the closed position. A hanging cable or wire 4302 is connected to an end of the internal supporting structure 4202, and the cable or wire 4302 extends up and out of the exterior body.

Figure 44A:
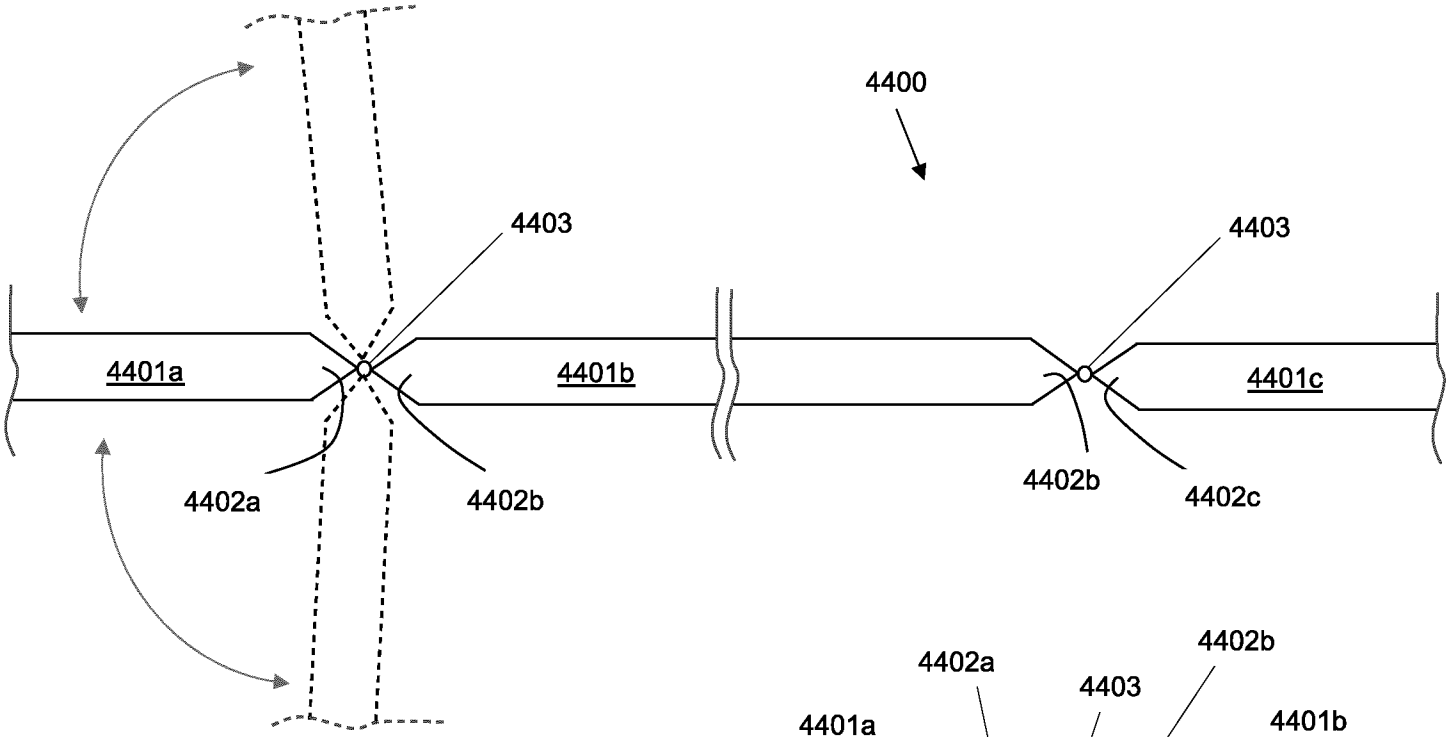
FIG. 44*a* is a top view of a series of internal structures joined together in seriatim with a flexible joint, according to another example embodiment.

Turning to FIG. 44*a*, multiple internal structures 4401*a*, 4401*b*, 4401*c* are shown in a top view being connected to each other in seriatim. They are joined together with movable joints 4403. The exterior body or exterior bodies that shroud the internal structures are not shown here so as to more clearly show the features of the internal structures and their connection to each other. Different types of exterior bodies can be used to shroud the internal structures.

As can be seen, the end portion 4402*a* of the internal structure 4401*a* narrows or gradually becomes smaller towards its outermost end, where it connects to the movable joint 4403. The end portion 4402*b* of the internal structure 4401*b*, which also connects to the movable joint 4403 to connect to the internal structure 4401*a*, also narrows towards its outermost end. In this way, when the internal structures 4401*a* and 4401*b* rotate relative to each other (e.g. yaw), there is space for them to rotate across a large range of angles.

The end portions 4402*b* and 4402*c* of the respective internal structures 4401*b* and 4401*c* are also narrowed or angled to a small size to allow for a larger range of rotation.

Figure 44B:
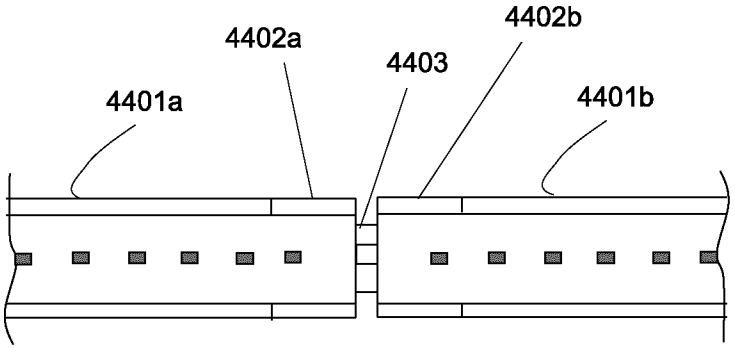
FIG. 44*b* is a side view of two of the internal structures shown in FIG. 44*a*.

FIG. 44*b* shows a side view of the internal structures 4401*a* and 4401*b* shown in FIG. 44*a*. The movable joint 4403, in this example, is a hinge that includes interlocking knuckles held together with a pin. The internal structures are able to rotate (e.g. yaw) around the vertical axis defined by the pin.

It can be appreciated that other types of movable joints can be used.

Figure 45A:
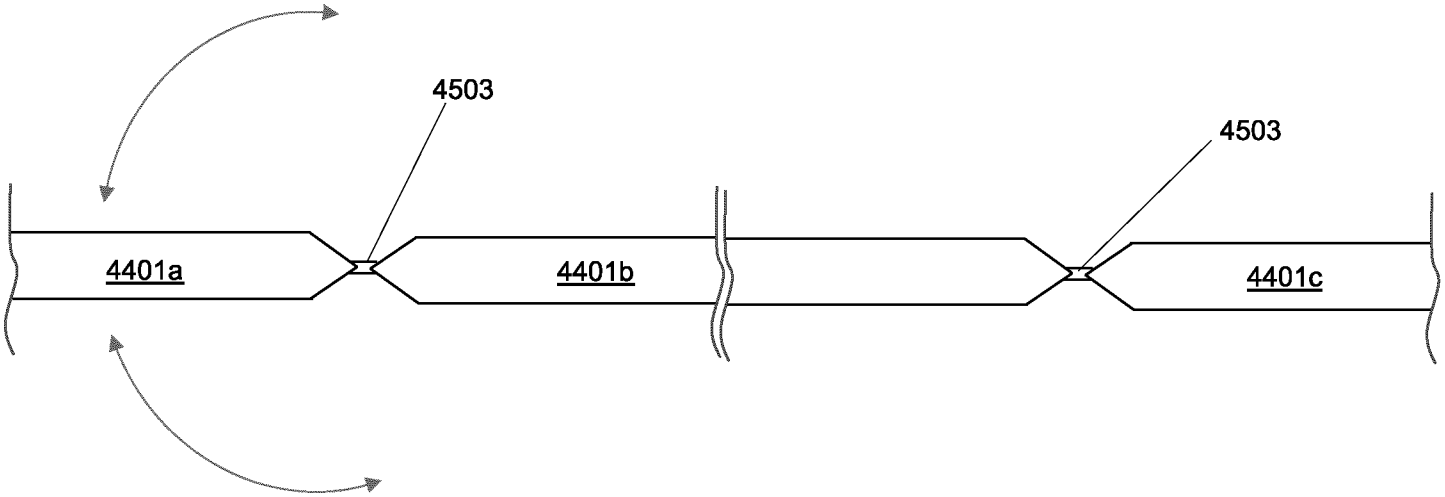
FIG. 45*a* is a top view of a series of internal structures joined together in seriatim with a flexible joint, according to another example embodiment.
Figure 45B:
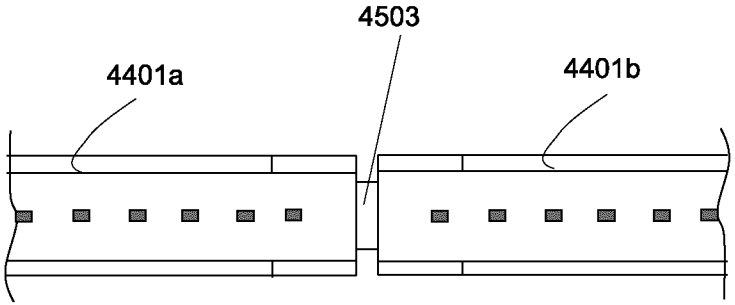
FIG. 45*b* is a side view of two of the internal structures shown in FIG. 45*a*.

FIGS. 45*a* and 45*b* shown another movable joint 4503 that is a flexible material that allows connected internal structures to rotate relative to each other. For example, the flexible material is one or more of plastic, rubber, fabric, a textile, a metal, etc. that allows for flexing back and forth.

Figure 46A:
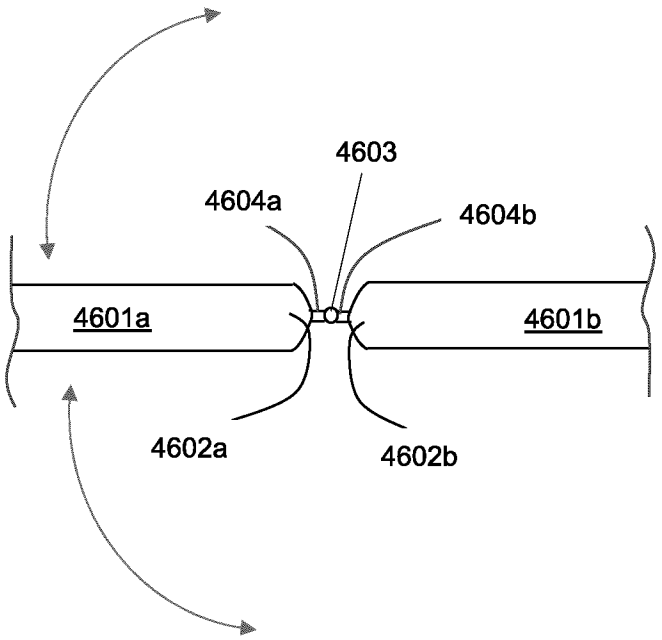
FIG. 46*a* is a top view of a series of internal structures joined together in seriatim with a flexible joint, according to another example embodiment.

FIG. 46*a* shows, from a top view, another example embodiment of two internal structures 4601*a* and 4601*b* connected together using a ball joint 4604. The end portion 4602*a* of a flange of the internal structure 4601*a* has a curved end, and the end portion 4602*b* of a flange of the internal structure 4601*b* also has a curved end. They are curved to allow for a larger range of rotation (e.g. in the yawing motion). In other words, the narrowing shape does not need to be linear (e.g. a straight line), but can take on other shapes, including and not limited to a curved end.

Figure 46B:
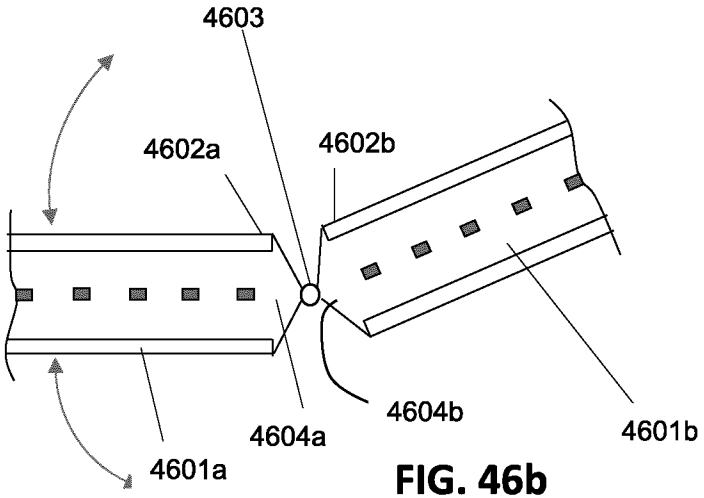
FIG. 46*b* is a side view of two of the internal structures shown in FIG. 46*a*.

As can be seen in FIG. 46*b*, which shows the side view, an end portion of the web 4604*a* juts out from the flange and the end portion of the web 4604*a* also narrows as it extends towards the ball joint 4603. Similarly, the end portion of the web 4606*b* also narrows as it extends towards the same ball joint 4603. This allows for a greater range of angles that the two internal structures 4601*a* and 4601*b* can pitch relative to each other.

Other types of joints that can be used to connect two ends of internal structures, while providing yaw or pitch rotational freedom, or both, between these internal structures, are applicable to the principles described herein.

Below are general example embodiments and example features of the embodiments.

In a general example embodiment, a lighting system includes: an exterior body defining a void therein and an internal structure positioned within the void; the internal structure comprising at least a web and a flange extending from the web, and one or more lights positioned along the length of the web; and the internal structure supports the exterior body.

In an example aspect, the exterior body comprises a bottom surface having holes for light to pass through.

In another example aspect, the flange is a lower flange relative to the web.

In another example aspect, the lower flange is translucent.

In another example aspect, the lower flange is opaque.

In another example aspect, the internal structure further comprises an upper flange extending from the web.

In another example aspect, the upper flange is opaque.

In another example aspect, at least a lower surface of the upper flange is textured.

In another example aspect, at least the lower surface of the upper flange is powder coated.

In another example aspect, at least the lower surface of the upper flange is reflective.

In another example aspect, the upper flange is translucent.

In another example aspect, the upper flange is a same color or a similar color as the exterior body.

In another example aspect, the lower flange is a same color or a similar color as the exterior body.

In another example aspect, the internal structure is an elongate beam that comprises the web and the flange, and the web and the flange are made of metal.

In another example aspect, the web and the flange are curved to form a curved internal structure.

In another example aspect, the curved internal structure is ring-shaped.

In another example aspect, there are multiple lights positioned on one side of the web and there are multiple lights positioned on an opposite side of the web.

In another example aspect, the number of lights positioned on the one side of the web is greater than the number of lights positioned on the opposite side of the web.

In another example aspect, the internal structure is a ring-shaped internal structure, and the one side of the web faces outwards on the ring-shaped internal structure and the opposite side of the web faces inwards on the ring-shaped internal structure.

In another example aspect, the number of lights positioned on the one side of the web is equal to the number of lights positioned on the opposite side of the web.

In another example aspect, there are at least two rows of lights positioned on the one side of the web and there are at least two rows of lights positioned on the opposite side of the web.

In another example aspect, there are two rows of lights positioned on the one side of the web and there is one row of lights positioned on the opposite side of the web.

In another example aspect, the upper flange has a greater width than the lower flange.

In another example aspect, the upper flange has a greater length than the lower flange.

In another example aspect, the upper flange and the web have the same length.

In another example aspect, the internal structure further comprises a second flange extending from the web and positioned on the web opposite to the flange.

In another example aspect, one of the flange and the second flange are opaque, the other one of the flange and the second flange is translucent.

In another example aspect, both the flange and the second flange are opaque.

In another example aspect, both the flange and the second flange are translucent.

In another example aspect, the web and one of the flange and the second flange are a unitary structure, and the other one of the flange and the second flange is attached to the unitary structure.

In another example aspect, both the flange and the second flange are horizontally oriented relative to the web.

In another example aspect, at least one of the flange and the second flange are curved about a longitudinal axis defined by the web.

In another example aspect, at least one of the flange and the second flange are angled more than 90 degrees relative to the web.

In another example aspect, at least one of the flange and the second flange are angled less than 90 degrees relative to the web.

In another example aspect, the web is translucent.

In another example aspect, the web is transparent.

In another example aspect, the web is opaque.

In another example aspect, an inner surface of the exterior body rests on the flange, the inner surface defining part of the void.

In another example aspect, the flange and the web form an L-shaped cross-section of the internal structure.

In another example aspect, the flange and the web form a T-shaped cross-section of the internal structure.

In another example aspect, one or more lines are attached to the internal structure to hang the lighting system.

In another example aspect, multiple ones of the internal structure are positioned within the void of the exterior body.

In another example aspect, the multiple internal structures are angled relative to each other.

In another example aspect, the multiple internal structures are arranged in a line and the exterior body covers the length of the line.

In another general example embodiment, a lighting system comprises: an exterior body defining a void therein and an elongate internal structure positioned within the void; the internal structure comprising a web, an upper flange that is opaque and extends outwards on both sides of the web, a lower flange that is translucent and extends outwards on both sides of the web, and lights positioned on both sides of the web; and the internal structure supports the exterior body.

In an example aspect, the upper flange has a greater width than the lower flange.

In another example aspect, the upper flange has a greater length than the lower flange.

In another example aspect, the web and the upper flange are a metal structure.

In another example aspect, the metal structure is powder coated.

In another example aspect, the exterior body, the web, the upper flange and the lower flange are of a similar color.

In another example aspect, the exterior body has holes located on its top surface and holes located on its bottom surface.

In another general example embodiment, a lighting system comprises: a circular exterior body defining a circular void therein with a circular internal structure and an outer ring positioned within the circular void; the circular internal structure comprising a web and a flange and lights positioned on the web; the outer ring having a larger diameter than the circular internal structure with multiple lines that extend radially from the circular internal structure to the outer ring; and the circular internal structure and the outer ring support the circular exterior body.

In an example aspect, the flange is a lower flange that extends radially outwards from the web.

In another example aspect, the lower flange is opaque.

In another example aspect, multiple lights are positioned on an outward facing surface of the web and multiple lights are positioned on an inward facing surface of the web.

In another example aspect, the number of the multiple lights positioned on the outward facing surface of the web is greater than the number of the multiple lights positioned on the inward facing surface of the web.

In another example aspect, the outer ring comprises multiple rods joined together at their ends by joints.

In another example aspect, the multiple lines respectively extend between the joints and the circular internal structure.

In another example aspect, the rods are resilient flexible to form a curved section of the outer ring and, in a relaxed state, each of the rods are straight.

In another example aspect, the rods are carbon fiber rods.

In another example aspect, there are three rods that are joined together by three joints.

In another example aspect, the joints are rigid tubes that have hollow ends, and a given joint has inserted into it ends of two given rods.

In another general example embodiment, a lighting system includes at least two elongate structures positioned within the void and connected in seriatim with each other at the ends with a movable joint. Each of the internal structures comprising at least a web and a flange extending from the web, and one or more lights positioned along the length of the web; and each of the internal structures support the exterior body.

In an example aspect, the lighting system further includes an exterior body defining a void therein and the at least two elongate structures are positioned within the void.

In another example aspect, the exterior body is flexible and flexes around the movable joint.

In another example aspect, the movable joint is a hinge.

In another general example embodiment, a kit of parts for a lighting system includes an expandable exterior body defining a void therein. The kit also includes an internal structure comprising at least a web and a flange extending from the web, and one or more lights positioned along the length of the web. In assembly, the internal structure is positioned within the void of the expandable exterior body and the internal structure supports the exterior body.

Various features described herein from different example embodiments can be combined together, although such combinations have not been explicitly described. For example, the different types of flanges can be combined together to form different configurations of internal support structures. Different types of internal support structures can be combined with different types of exterior bodies to form different lighting systems.

It will be appreciated that the particular example embodiments shown in the figures and described above are for illustrative purposes only and many other variations can be used according to the example embodiments described herein. Although the above has been described with reference to specific example embodiments, various modifications thereof will be apparent to those skilled in the art as outlined in the appended claims.

The invention claimed is:

1. A hanging lighting system comprising:

a flexible exterior body defining a void therein and an internal structure, which is separate from the flexible exterior body, is positioned within the void; the void defined by at least an upper surface and the upper surface of the void rests on the internal structure, which supports the flexible exterior body; the internal structure comprising at least a web and a flange extending from the web, and one or more lights are positioned along a length of the internal structure; and, one or more supports configured for hanging the hanging lighting system are connected to the internal structure and extend above a top surface of the flexible exterior body.

2. The hanging lighting system of claim 1 wherein the flange is a lower flange relative to the web.

3. The hanging lighting system of claim 2 wherein the lower flange is translucent.

4. The hanging lighting system of claim 1 wherein the flange is an upper flange relative to the web.

5. The hanging lighting system of claim 1 wherein the one or more lights are multiple lights that are positioned on a length of the flange.

6. The handing lighting system of claim 1 wherein the web and the flange are curved to form a curved internal structure.

7. The hanging lighting system of claim 1 wherein the one or more lights are multiple lights that are positioned along a length of the web.

8. The hanging lighting system of claim 1 wherein the internal structure further comprises a second flange extending from the web and positioned on the web opposite to the flange.

9. The hanging lighting system of claim 8 wherein one of the flange and the second flange is opaque, the other one of the flange and the second flange is translucent.

10. The hanging lighting system of claim 1 wherein the flexible exterior body is a wall; and, the void is an internal passage extending along a length of the flexible exterior body and is positioned in an upper portion of the wall.

11. The hanging lighting system of claim 1 wherein the flange and the web form a T-shaped cross-section of the internal structure, and wherein the web protrudes downwards from the flange.

12. The hanging lighting system of claim 1 wherein the one or more supports configured for hanging the hanging lighting system comprise a plurality of lines that are attached to the internal structure.

13. The hanging lighting system of claim 1 wherein at least a first one and a second one of the internal structure are positioned within the void of the flexible exterior body, each of the first one and the second one of the internal structure comprising an elongate shape with a first end and a second end oppositely positioned lengthwise on the elongate shape, and the first end of each of the first one and the second one of the internal structure point towards each other, and the second end of the first one and the second one of the internal structure point away from each other.

14. The hanging lighting system of claim 1 wherein at least a first one and a second of the internal structure are positioned to form a line within the void of the flexible exterior body, and the flexible exterior body covers an entire length of the line.

15. The hanging lighting system of claim 1 wherein at least a first one and a second one of the internal structure are positioned lengthwise in seriatim within the void of the flexible exterior body, each of the first one and the second one of the internal structure comprising an elongate shape, and a movable joint connects an end portion of the first one of the internal structure to an end portion of the second one of the internal structure.

16. The hanging lighting system of claim 15 further wherein the end portion of the first one of the internal structure tapers in width to the moveable joint, and the end portion of the second one of the internal structure tapers in width to the movable joint.

17. A lighting system comprising:

an exterior body defining a void therein and an internal structure positioned within the void; the internal structure comprising a web, and a first flange and a second flange that extend from the web, and one or more lights are positioned on the internal structure; and the internal structure supports the exterior body; and, wherein, one of the first flange and the second flange is opaque, and the other one of the first flange and the second flange is translucent.

18. A lighting system comprising:

a flexible exterior body defining a void therein and a first and a second elongate structures are positioned within the void and connected lengthwise in seriatim with a movable joint, the void defined by at least an upper surface and the upper surface of the void rests on the first and the second elongate structures, which support the flexible exterior body; one or more lights positioned along a length of each of the first and the second elongate structures; and the flexible exterior body flexes around the movable joint.

19. A kit of parts for a handing lighting system comprising:

a collapsible and expandable exterior body defining a void therein;

a structure, which is separate from the collapsible and expandable exterior body, comprising a web and a flange extending from the web, and one or more lights positioned along a length of the structure; and one or more supports configured for hanging the hanging lighting system;

wherein, in assembly, the structure is positioned within the void of the collapsible and expandable exterior body, the collapsible and expandable exterior body is extended from a collapsed state to an expanded state along a length of the structure, the structure supports the collapsible and expandable exterior body, and the one or more supports are attached to the structure and extend above a top surface of the collapsible and expandable exterior body.

20. The kit of parts of claim 19 wherein the collapsible and expandable exterior body is a wall; and, the void is an internal passage extending along a length of the collapsible and expandable exterior body and is positioned in an upper portion of the wall.

21. The kit of parts of claim 19 further comprising a second structure, which is separate from the collapsible and expandable exterior body; the second structure comprising an end portion of the second structure that is connectable to an end portion of the structure with a movable joint; wherein, in assembly, the structure is connected lengthwise in seriatim to the second structure by the movable joint and together are positioned within the void to support the collapsible and expandable structure in the expanded state; and, further wherein the collapsible and expandable exterior body flexes around the movable joint.

22. The lighting system of claim 18 wherein the movable joint connects an end portion of the first elongate structure to an end portion of the second elongate structure, and the end portion of the first elongate structure tapers in width to the moveable joint, and the end portion of the second elongate structure tapers in width to the movable joint.

* * * * *